US006905452B1

(12) United States Patent
Kirsch

(10) Patent No.: US 6,905,452 B1
(45) Date of Patent: Jun. 14, 2005

(54) APPARATUS FOR CENTRIFUGING A SLURRY

(75) Inventor: Raymond Kirsch, Java Center, NY (US)

(73) Assignee: Derrick Manufacturing Corporation, Buffalo, NY (US)

( * ) Notice: Subject to any disclaimer, the term of this patent is extended or adjusted under 35 U.S.C. 154(b) by 59 days.

(21) Appl. No.: 10/133,889

(22) Filed: Apr. 26, 2002

(51) Int. Cl.[7] ..... B04B 13/00; B04B 1/20
(52) U.S. Cl. ..... 494/8; 494/53; 700/273
(58) Field of Search ..... 494/1, 5, 7–10, 494/12, 27, 30, 42, 52–54, 84; 210/97, 103, 134, 143, 380.3; 700/273

(56) References Cited

U.S. PATENT DOCUMENTS 2,955,753 A 10/1960 O'Conor et al.
3,228,594 A * 1/1966 Amero ..... 494/53
3,494,542 A * 2/1970 Finkelston et al. ..... 494/7
4,070,290 A * 1/1978 Crosby ..... 494/10
4,073,431 A 2/1978 Juger
4,228,949 A 10/1980 Jackson
4,240,578 A 12/1980 Jackson
4,303,192 A * 12/1981 Katsume ..... 494/10
4,668,213 A * 5/1987 Krämer ..... 494/84
5,203,762 A 4/1993 Cooperstein
5,282,780 A 2/1994 Epper et al.
5,403,260 A * 4/1995 Hensley ..... 494/53
5,681,256 A * 10/1997 Nagafuji ..... 494/84
5,857,955 A 1/1999 Phillips et al.
5,865,718 A * 2/1999 Chan ..... 700/273
5,919,123 A * 7/1999 Phillips ..... 494/7
5,948,271 A * 9/1999 Wardwell et al. ..... 210/143
6,328,897 B1 * 12/2001 Leung ..... 210/143
6,368,264 B1 * 4/2002 Phillips et al. ..... 494/5

FOREIGN PATENT DOCUMENTS

DE 2525280 * 12/1976

* cited by examiner

*Primary Examiner*—Charles E. Cooley
(74) *Attorney, Agent, or Firm*—Simpson & Simpson, PLLC

(57) ABSTRACT

A method and apparatus for centrifuging. The apparatus comprises a centrifuge for centrifuging a slurry, including a bowl driven by a bowl drive motor, a screw conveyor driven by a screw conveyor drive motor, a pump driven by a pump motor, a bowl drive unit operatively arranged to drive the bowl drive motor, a conveyor drive unit operatively arranged to drive the screw conveyor drive motor, a pump drive unit operatively arranged to drive the pump drive motor; and, a general purpose first computer specially programmed to control the bowl drive unit to drive the bowl drive motor at a first constant speed and to control the screw conveyor drive unit to drive the screw conveyor drive motor at a second constant speed and to monitor the torques of the bowl drive motor and the screw conveyor drive motor, while simultaneously controlling the pump drive unit to variably control flow of the slurry through the centrifuge in response to variations in developed torque of whichever of the bowl motor or screw conveyor motor which is operating closest to its rated torque. The method comprises steps to monitor torques of the bowl and conveyor motors, which are operating at constant speeds, and controlling the pump motor to regulate flow based upon the monitored torques.

9 Claims, 29 Drawing Sheets

VFD CENTRIFUGE CONTROL SCHEME

Data Conversion and Averaging Subroutine

APPARATUS FOR CENTRIFUGING A SLURRY

REFERENCE TO COMPUTER PROGRAM LISTING APPENDIX

This patent includes a computer program listing appendix on compact disc. Two duplicate compact discs are provided herewith. Each compact disc contains a plurality of a the computer program listing as follows:

Filename: DERP 101_US.txt Computer Program Listing
Size: 88 KB
Date Created: Apr. 26, 2002
Filename: Alarms_Alarm Setup.HTM Computer Program Listing
Size: 11 KB
Date Created: Apr. 24, 2002
Filename: Cent_Interface.HTM Computer Program Listing
Size: 7 KB
Date Created: Apr. 24, 2002
Filename: Datalo~1.HTM Computer Program Listing
Size: 6 KB
Date Created: Apr. 24, 2002
Filename: Datalo~2.HTM Computer Program Listing
Size: 5 KB
Date Created: Apr. 24, 2002
Filename: Gr6ff8~1.HTM Computer Program Listing
Size: 12 KB
Date Created: Apr. 24, 2002
Filename: Gr6ff9~1.HTM Computer Program Listing
Size: 31 KB
Date Created: Apr. 24, 2002
Filename: Gr6ffa~1.HTM Computer Program Listing
Size: 81 KB
Date Created: Apr. 24, 2002
Filename: Gr6ffb~1.HTM Computer Program Listing
Size: 43 KB
Date Created: Apr. 24, 2002
Filename: Gr6ffb~2.HTM Computer Program Listing
Size: 20 KB
Date Created: Apr. 24, 2002
Filename: Gr6ffc~1.HTM Computer Program Listing
Size: 64 KB
Date Created: Apr. 24, 2002
Filename: Gr6ffd~1.HTM Computer Program Listing
Size: 32 KB
Date Created: Apr. 24, 2002
Filename: Gr6ffd~2.HTM Computer Program Listing
Size: 37 KB
Date Created: Apr. 24, 2002
Filename: Gr6ffe~1.HTM Computer Program Listing
Size: 44 KB
Date Created: Apr. 24, 2002
Filename: Gr6fff~1.HTM Computer Program Listing
Size: 139 KB
Date Created: Apr. 24, 2002
Filename: Gr7000~1.HTM Computer Program Listing
Size: 13 KB
Date Created: Apr. 24, 2002
Filename: Gr7001~1.HTM Computer Program Listing
Size: 13 KB
Date Created: Apr. 24, 2002
Filename: Gr7001~2.HTM Computer Program Listing
Size: 3 KB
Date Created: Apr. 24, 2002
Filename: Gr7002~1.HTM Computer Program Listing
Size: 3 KB Date Created: Apr. 24, 2002
Filename: Gr7002~2.HTM Computer Program Listing
Size: 1 KB
Date Created: Apr. 24, 2002
Filename: Gr7002~3.HTM Computer Program Listing
Size: 1 KB
Date Created: Apr. 24, 2002
Filename: Gr7003~1.HTM Computer Program Listing
Size: 3 KB
Date Created: Apr. 24, 2002
Filename: Graphi~1.HTM Computer Program Listing
Size: 21 KB
Date Created: Apr. 24, 2002
Filename: Graphi~2.HTM Computer Program Listing
Size: 16 KB
Date Created: Apr. 24, 2002
Filename: Graphi~3.HTM Computer Program Listing
Size: 74 KB
Date Created: Apr. 24, 2002
Filename: Graphi~4.HTM Computer Program Listing
Size: 42 KB
Date Created: Apr. 24, 2002
Filename: Graphi~5.HTM Computer Program Listing
Size: 75 KB
Date Created: Apr. 24, 2002
Filename: Graphi~6.HTM Computer Program Listing
Size: 75 KB
Date Created: Apr. 24, 2002
Filename: Graphi~7.HTM Computer Program Listing
Size: 75 KB
Date Created: Apr. 24, 2002
Filename: Graphi~8.HTM Computer Program Listing
Size: 23 KB
Date Created: Apr. 24, 2002
Filename: Graphi~9.HTM Computer Program Listing
Size: 11 KB
Date Created: Apr. 24, 2002
Filename: Logica~1.HTM Computer Program Listing
Size: 4 KB
Date Created: Apr. 24, 2002
Filename: Logica~2.HTM Computer Program Listing
Size: 3 KB
Date Created: Apr. 24, 2002
Filename: Logica~3.HTM Computer Program Listing
Size: 4 KB
Date Created: Apr. 24, 2002
Filename: Logica~4.HTM Computer Program Listing
Size: 2 KB
Date Created: Apr. 24, 2002
Filename: Logica~5.HTM Computer Program Listing
Size: 2 KB
Date Created: Apr. 24, 2002
Filename: Logica~6.HTM Computer Program Listing
Size: 3 KB
Date Created: Apr. 24, 2002
Filename: Logica~6.HTM Computer Program Listing
Size: 3 KB
Date Created: Apr. 24, 2002
Filename: Logica~7.HTM Computer Program Listing
Size: 2 KB
Date Created: Apr. 24, 2002
Filename: DERP101aUS.txt Computer Program Listing
Size: 67 KB
Date Created: May 3, 2002

The computer program listing appendix is hereby expressly incorporated by reference in the present application.

FIELD OF THE INVENTION

The present invention relates generally to a method and apparatus for centrifuging and, more particularly, to a method and apparatus for centrifuging which inherently and automatically safeguards against overload of motors in the centrifuge, while maintaining efficient and effective centrifuging operation.

BACKGROUND OF THE INVENTION

One well-known type of centrifuge comprises a bowl and screw conveyor, each of which is driven by an electric motor. A danger in operating this type of centrifuge in some applications is that one or both of the motors may be presented with a load that will require the motor(s) to exceed rated torque. This could lead to motor failure and, is some circumstances, to system shutdown. In some applications, such as oil well drilling, for example, down-time caused by centrifuge failure could be extremely expensive. One obvious solution to this problem known in the art is to simply monitor motor torque and shut down the entire system when overload occurs. Another known solution is to simply shut off the feed pump (which supplies a slurry to the centrifuge for separation) when overload occurs. Both of these known solutions are unsatisfactory, however, as they both adversely affect overall system performance and/or efficiency. What is needed, then, is a method and apparatus for centrifuging which continuously monitors motor torques, and adjusts centrifuge performance automatically as load conditions change to ensure safe motor operation and efficient system operation.

SUMMARY OF THE INVENTION

The invention broadly comprises a method and apparatus for centrifuging. The apparatus comprises a centrifuge for centrifuging a slurry, including a bowl driven by a bowl drive motor, a screw conveyor driven by a screw conveyor drive motor, a pump driven by a pump motor, a bowl drive unit operatively arranged to drive the bowl drive motor, a conveyor drive unit operatively arranged to drive the screw conveyor drive motor, a drive unit operatively arranged to drive the pump drive motor; and, a general purpose first computer specially programmed to control the bowl drive unit to drive the bowl drive motor at a first constant speed and to control the screw conveyor drive unit to drive the screw conveyor drive motor at a second constant speed and to monitor the torques of the bowl drive motor and the screw conveyor drive motor, while simultaneously controlling the pump drive unit to variably control flow of the slurry through the centrifuge in response to variations in developed torque of whichever of the bowl motor or screw conveyor motor which is operating closest to its rated torque.

In a system having a centrifuge having a bowl and screw conveyor driven by a bowl motor and screw conveyor motor, respectively, where the system also includes a pump driven by a pump motor to provide a slurry load to be centrifuged by the centrifuge, a first method of controlling the system is provided, the method comprising the steps of:

a. shutting down the pump motor when the bowl motor develops torque at a first predetermined level, and, b. shutting down the centrifuge when the bowl motor develops torque at a second predetermined level.

In the same system, an improved method of controlling the system is provided, comprising the steps of:

a. shutting down the pump motor when the screw conveyor motor develops torque at a first predetermined level; and, b. shutting down the centrifuge when the screw conveyor motor develops torque at a second predetermined level.

In the same system, an improved method of controlling the system is provided, comprising the steps of:

a. controlling the pump motor when the bowl motor develops torque at a first predetermined level;

b. shutting down the pump motor when the bowl motor develops torque at a second predetermined level; and, c. shutting down the centrifuge when the bowl motor develops torque at a third predetermined level.

In the same system, an improved method of controlling the system is provided, comprising the steps of:

a. controlling the pump motor when the screw conveyor motor develops torque at a first predetermined level;

b. shutting down the pump motor when the screw conveyor motor develops torque at a second predetermined level; and, c. shutting down the centrifuge when the screw conveyor motor develops torque at a third predetermined level.

Finally, in the same system, an improved method of controlling the system is provided, comprising the steps of:

a. monitoring torque developed by the bowl motor;

b. monitoring torque developed by the screw conveyor motor;

c. determining which of the monitored torque of the bowl motor and the screw conveyor motor is closest to rated torque of the bowl motor and the screw conveyor motor, respectively, which determined torque is termed a predominant torque; and, d. using the predominant torque in a feedback control loop to control the pump motor.

A general object of the invention is to provide a method and apparatus for centrifuging which protects against centrifuge shutdown due to overloading of centrifuge motors.

A secondary object of the invention is to provide a method and apparatus for centrifuging which protects against overload of centrifuge motors by regulating the pump motor which, in turn, regulates the pump feeding slurry to the centrifuge, in response to monitored conditions of torque developed by centrifuge screw conveyor and bowl motors.

A further object of the invention is to provide a tri-level protection scheme for centrifuge operation, where the first level of protection regulates pump speed and flow rate, the second level shuts down the pump motor, and the third level shuts down the centrifuge, all in response to measured increasing levels of developed torque of either the bowl or screw conveyor motor.

Another object of the invention is to provide a control scheme for a centrifuge which substantially continuously monitors torques developed in response to load conditions in the centrifuge by the screw conveyor motor and bowl motor, determines which motor is operating closest to its rated torque (as a percentage of rated torque), and activates an associated PID control loop to regulate the pump motor based on this predominant torque motor.

These and other objects, features and advantages of the present invention will become readily apparent to those having ordinary skill in the art from a reading and study of the following detailed description of the invention, in view of the drawing and appended claims.

DESCRIPTION OF THE PREFERRED EMBODIMENT

It should be appreciated at the outset that the method and apparatus of centrifuging of the invention is suitable for use in a variety of applications—virtually any application that requires a centrifuge. In a preferred embodiment of the invention, the patentee tested the invention in an earth drilling application. Thus, while the description herein describes the invention in this particular application, it should be appreciated that the appended claims are not intended to be so limited. In addition, it should be appreciated that the centrifuge of the present invention is adaptable for use in either closed or open systems.

By way of background for one particular application, then, in earth drilling operations for oil, drilling mud and sometimes barites in combination with drilling mud, are used in a conventional manner for drill lubrication and carrying trailings to the surface. Drilling mud and barites are extremely expensive, and, in the past, various types of reclamation systems have been used which employed a centrifuge for separating the trailings from the drilling mud-trailing slurry.

In reading this patent, it should be appreciated that like reference numbers on different drawing views represent identical structural elements of the invention. It should also be appreciated that the centrifuge of the present invention is ultimately controlled by a general purpose industrial hardened computer specially programmed to control the bowl drive motor, the screw conveyor motor, and the pump motor. The computer also provides a user interface in the form of a monitor and is controlled through an attached pointing device (mouse). The source code running on the processor of the invention is included in the compact disc appendix, and is incorporated herein by reference.

Figure 1:
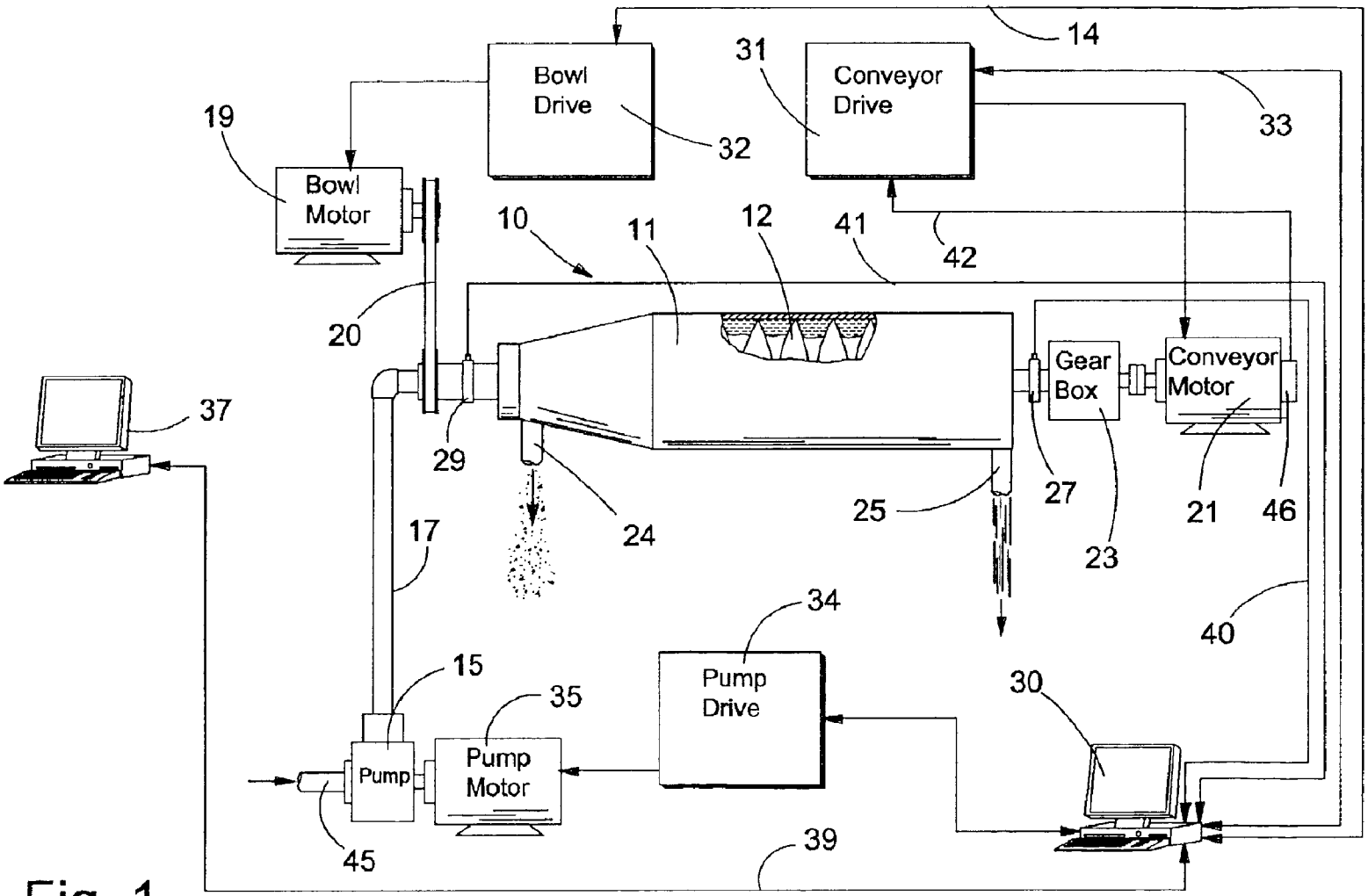
FIG. 1 is a schematic view of a drilling mud reclamation system wherein a centrifuge receives a slurry of drilling mud and trailings from a tank and has associated drives and computer controls coupled thereto.
Figure 2:
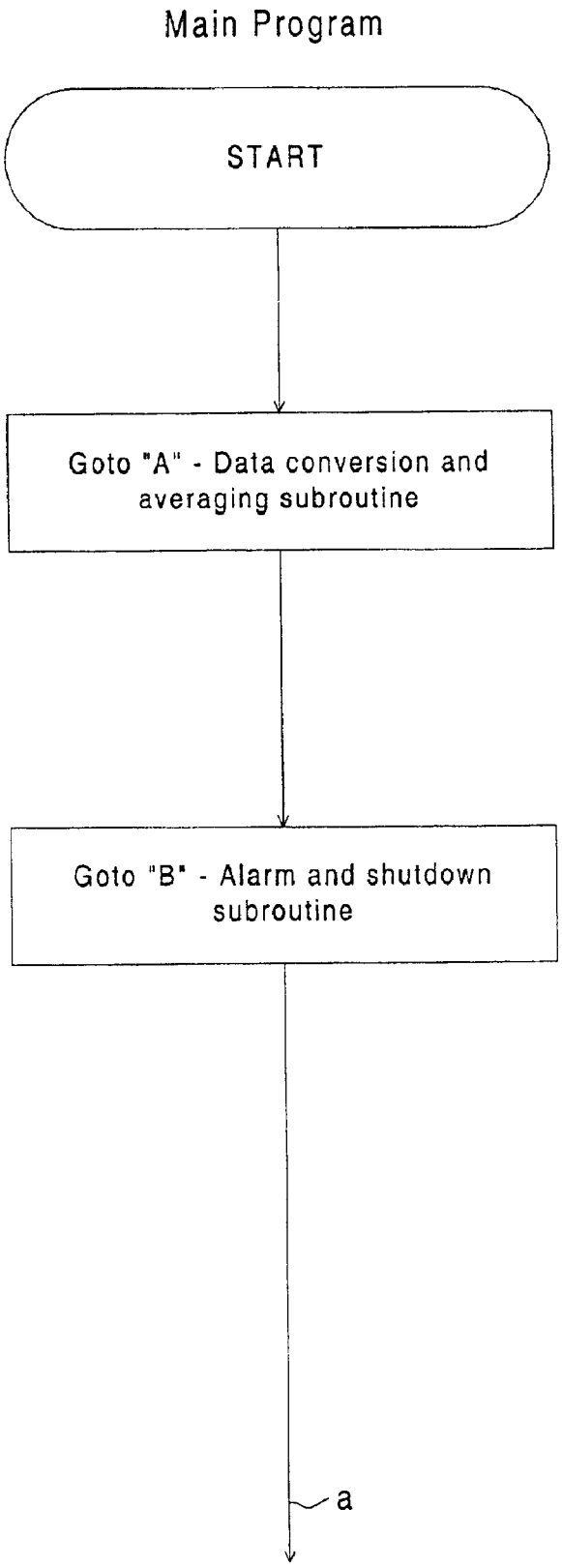
FIGS. 2–7 are flow charts depicting the logic for implementing the control of the variable frequency drive centrifuge.
Figure 3:
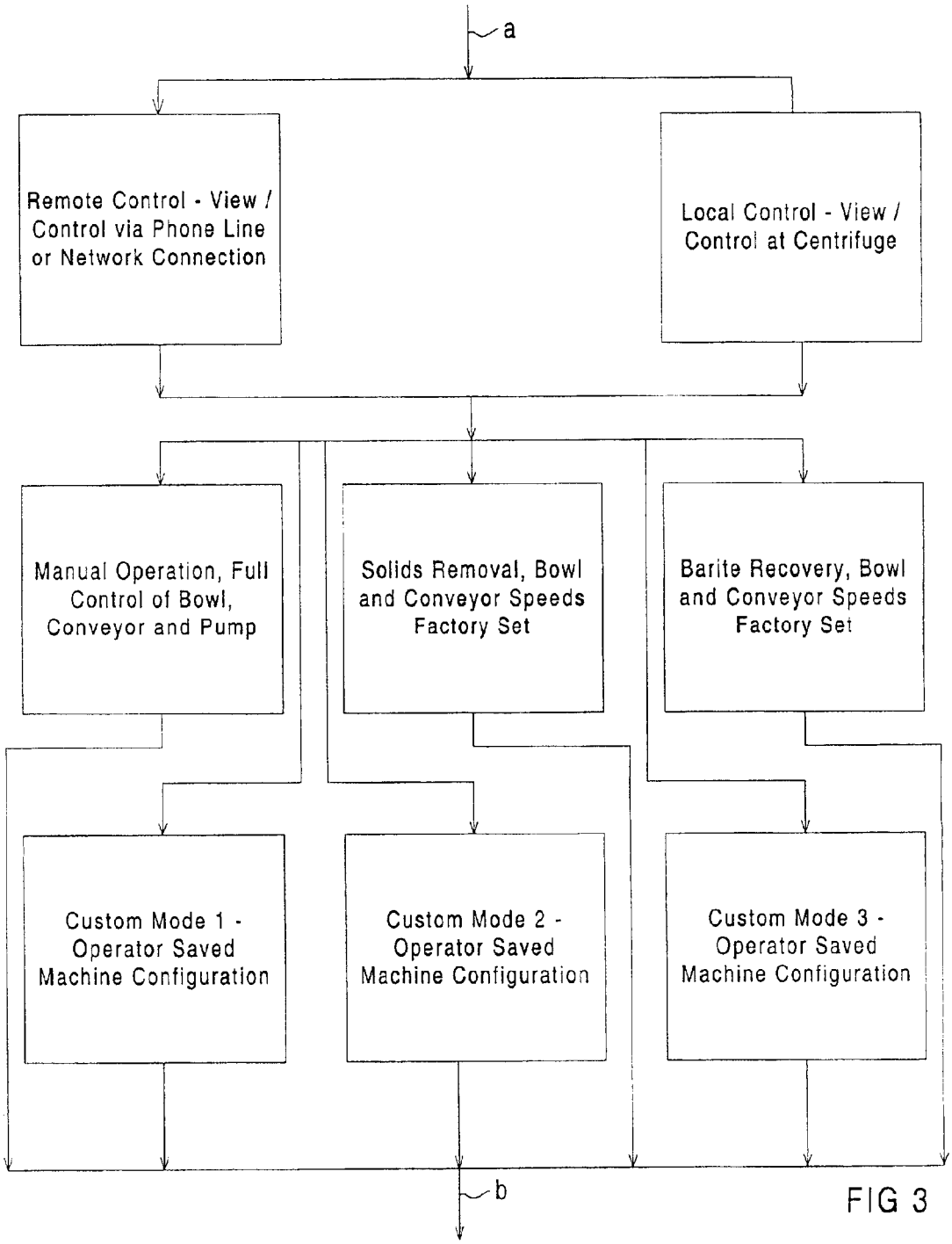
Figure 4:
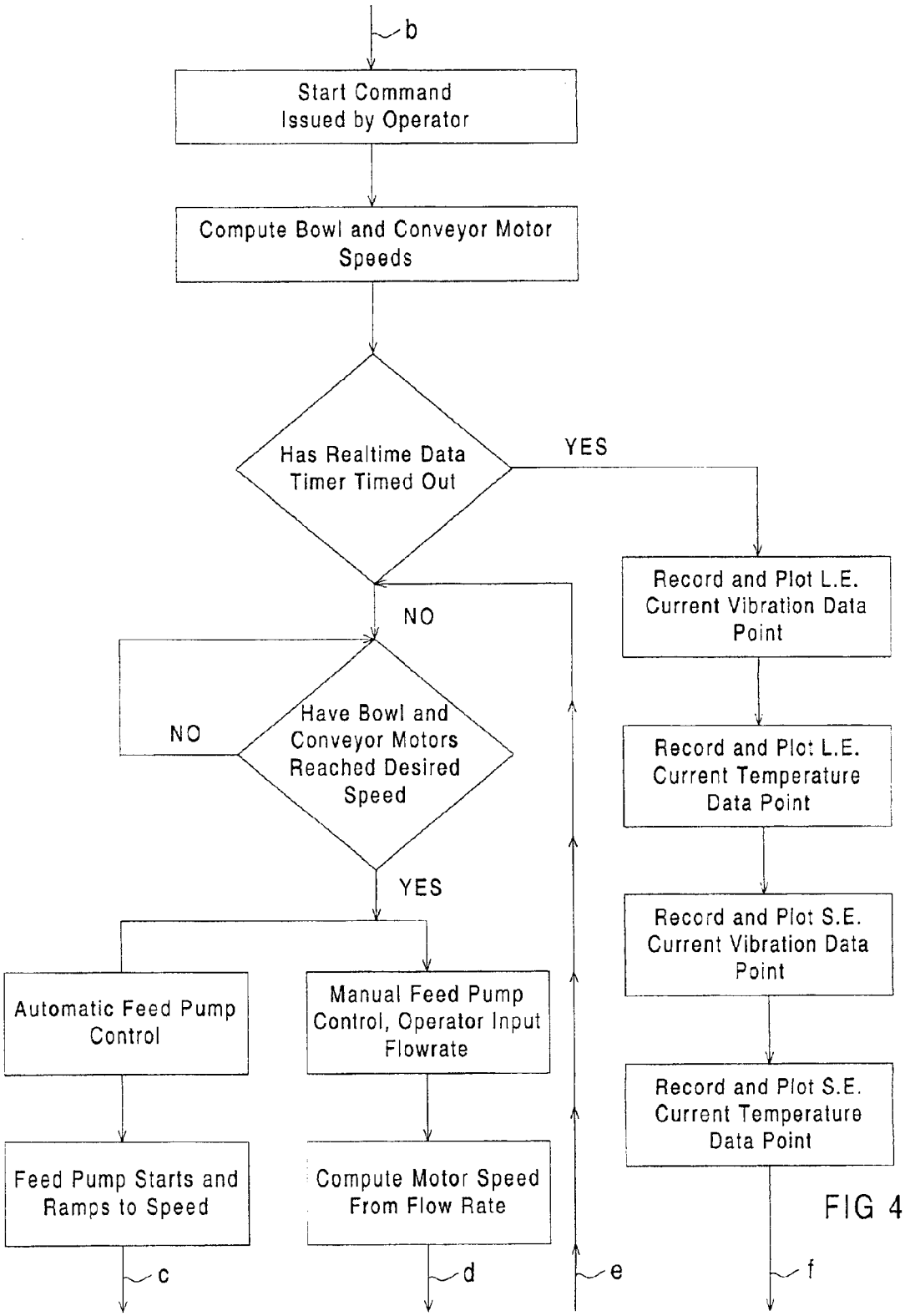
Figure 5:
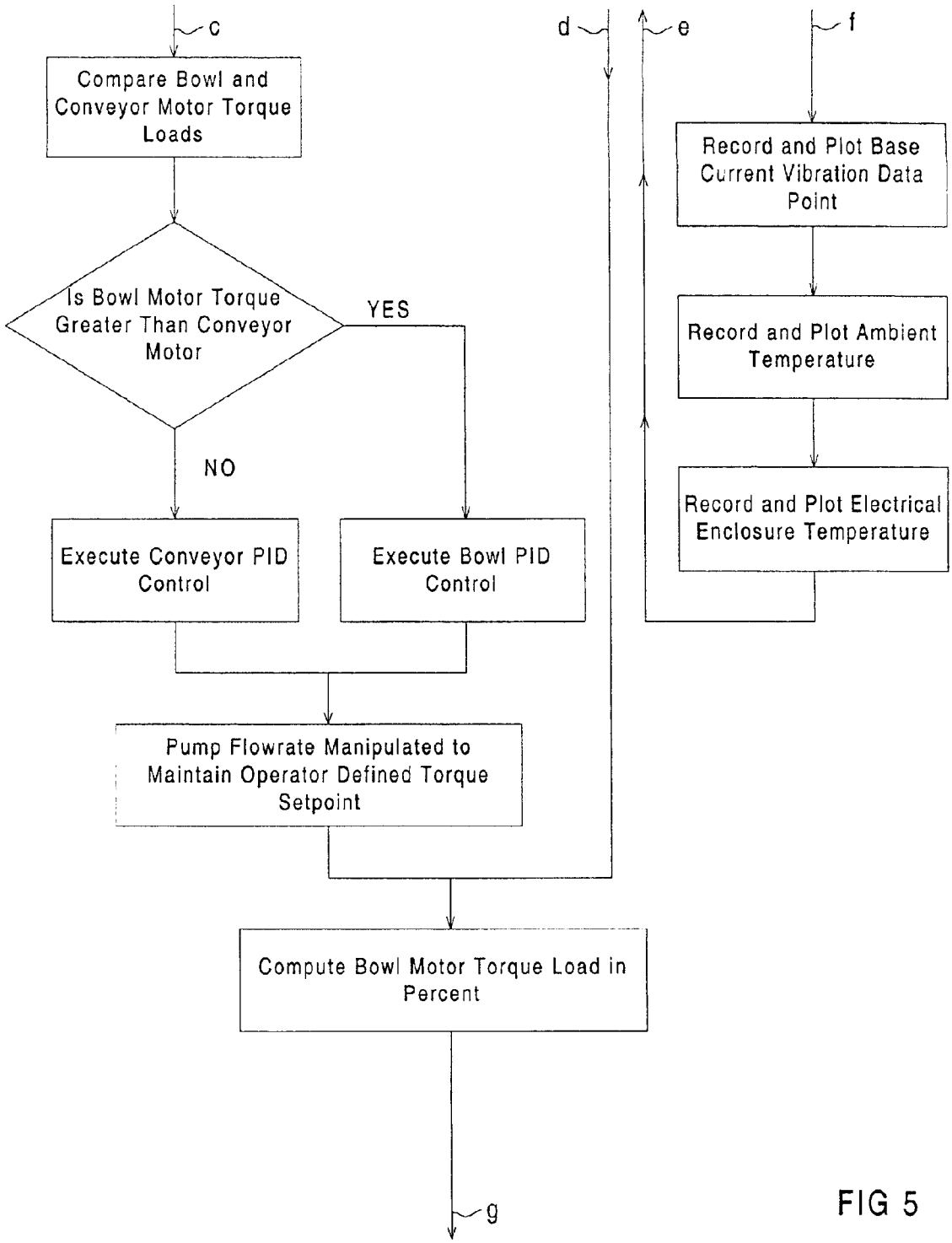
Figure 6:
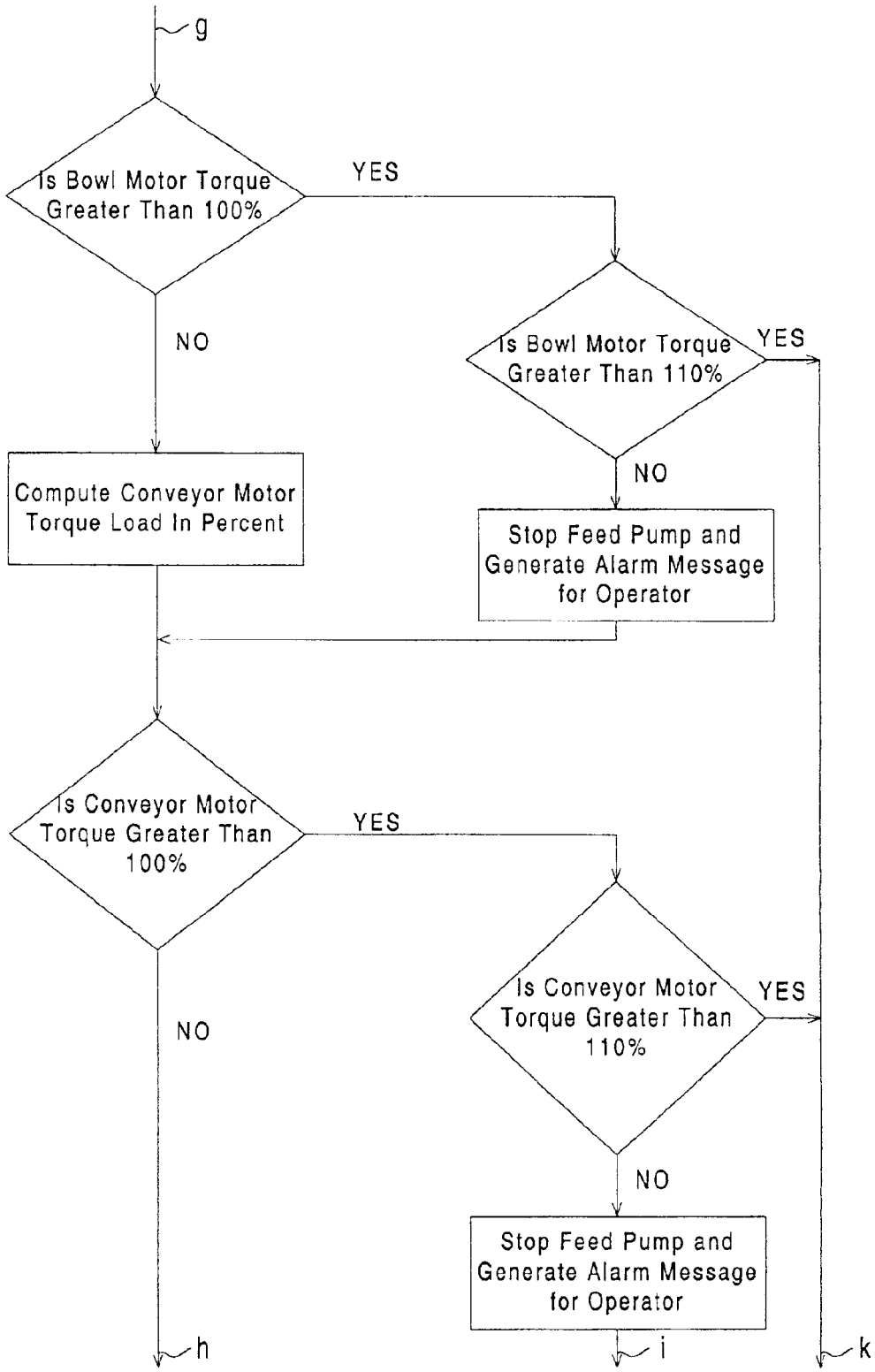
Figure 7:
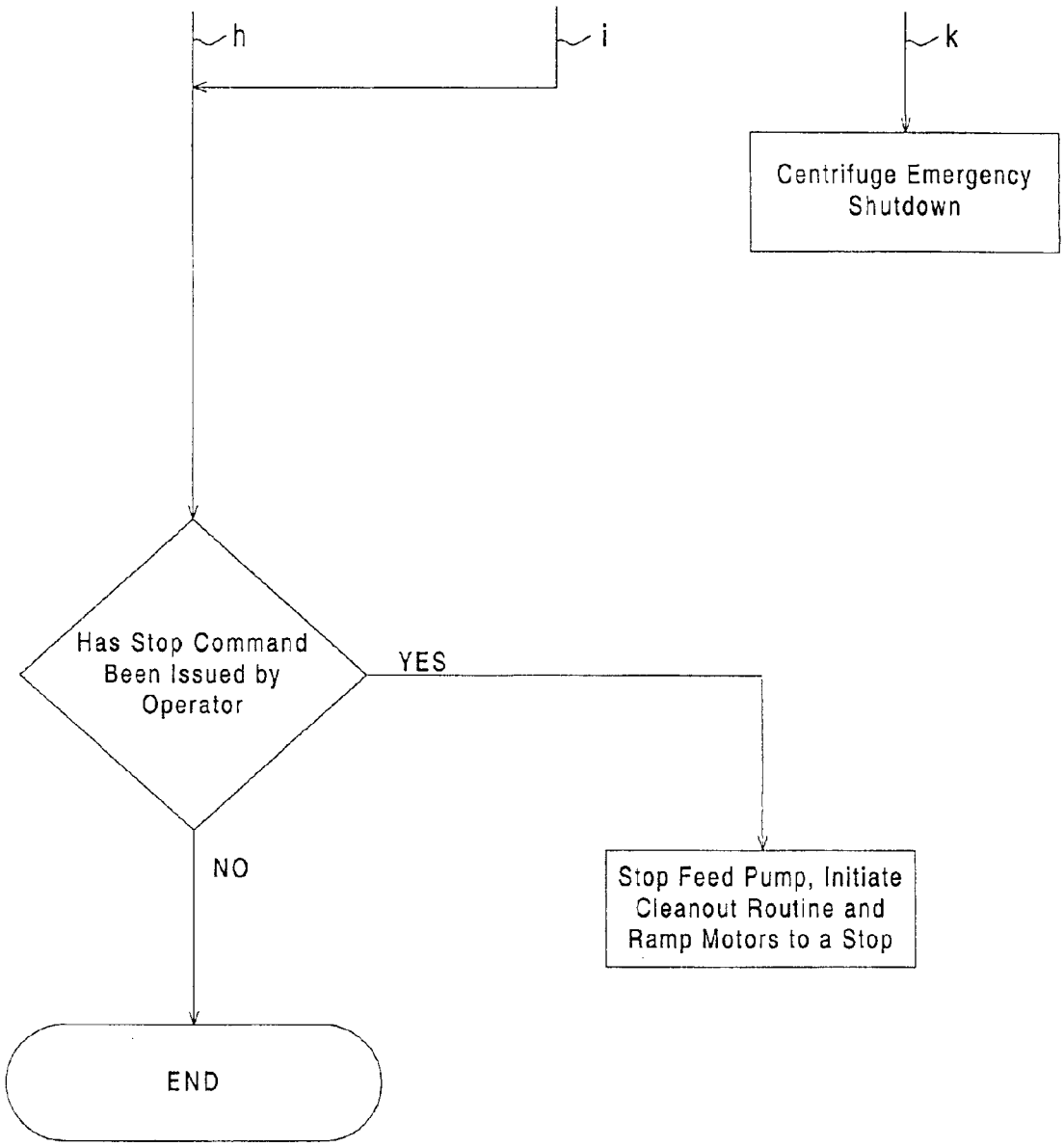
Figure 8:
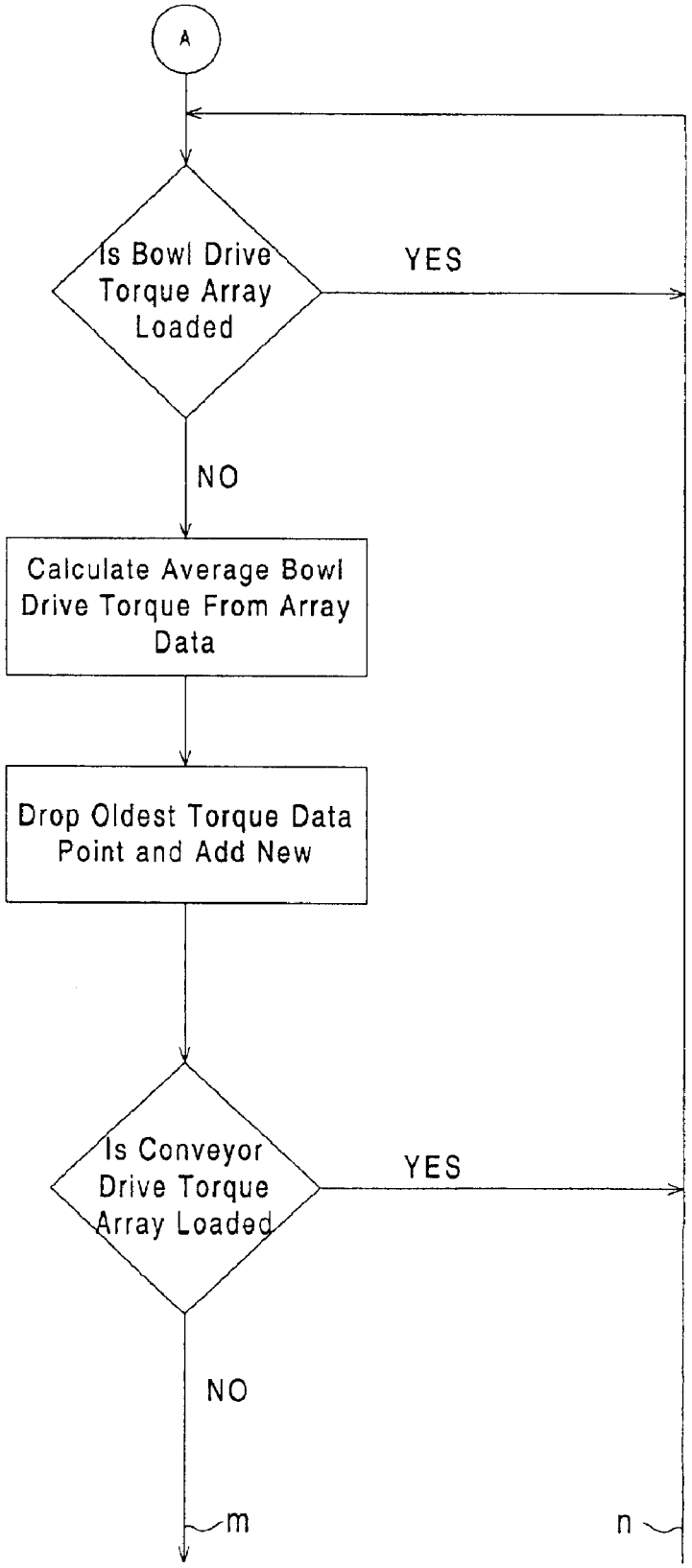
FIGS. 8–12 are flow charts illustrating the logic for the data conversion and averaging subroutine.
Figure 9:
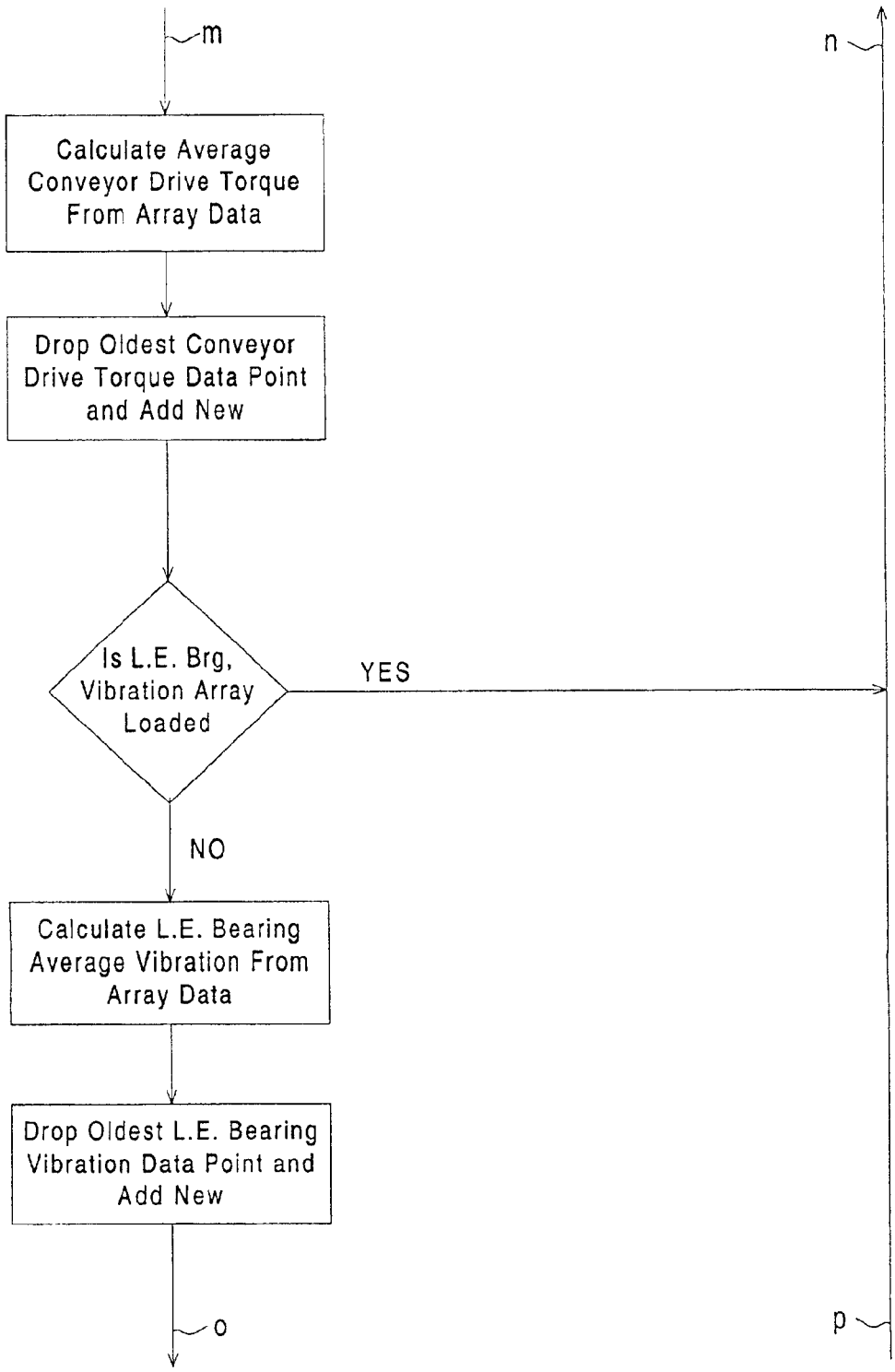
Figure 10:
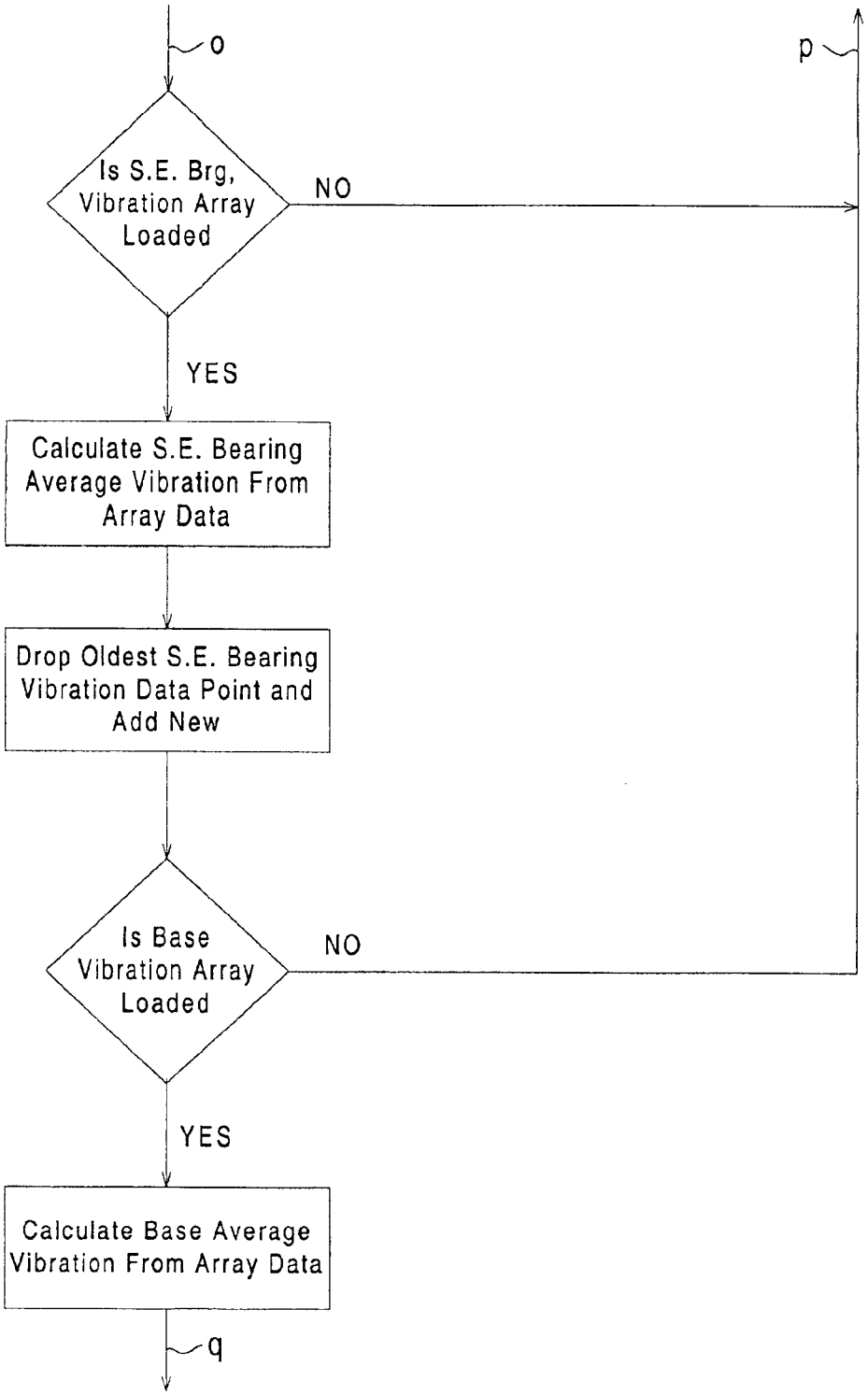
Figure 11:
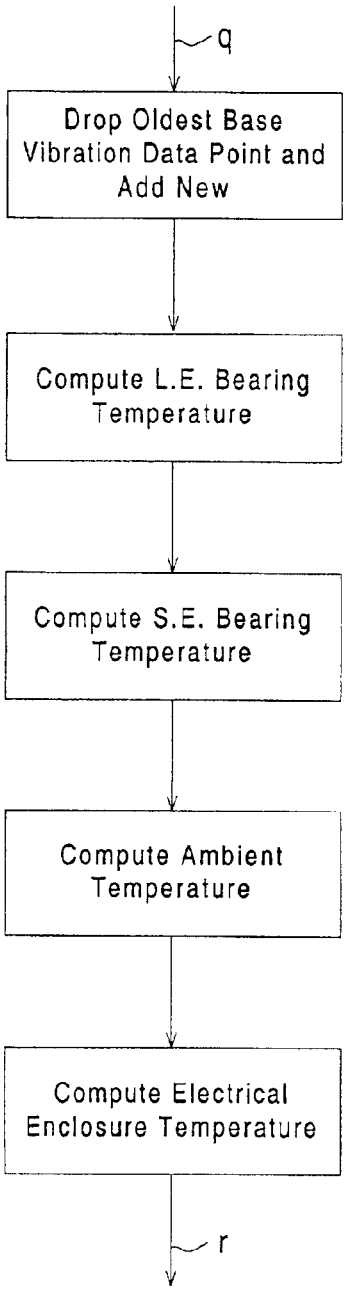
Figure 12:
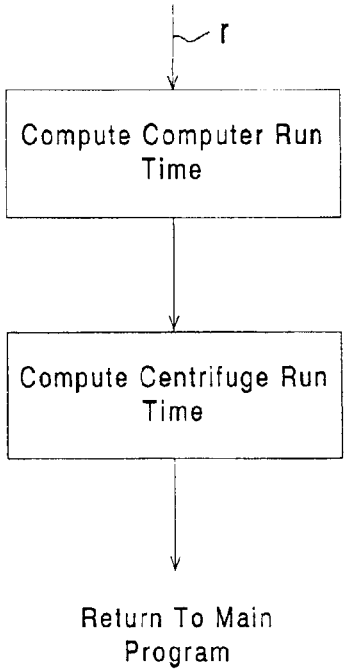
Figure 13:
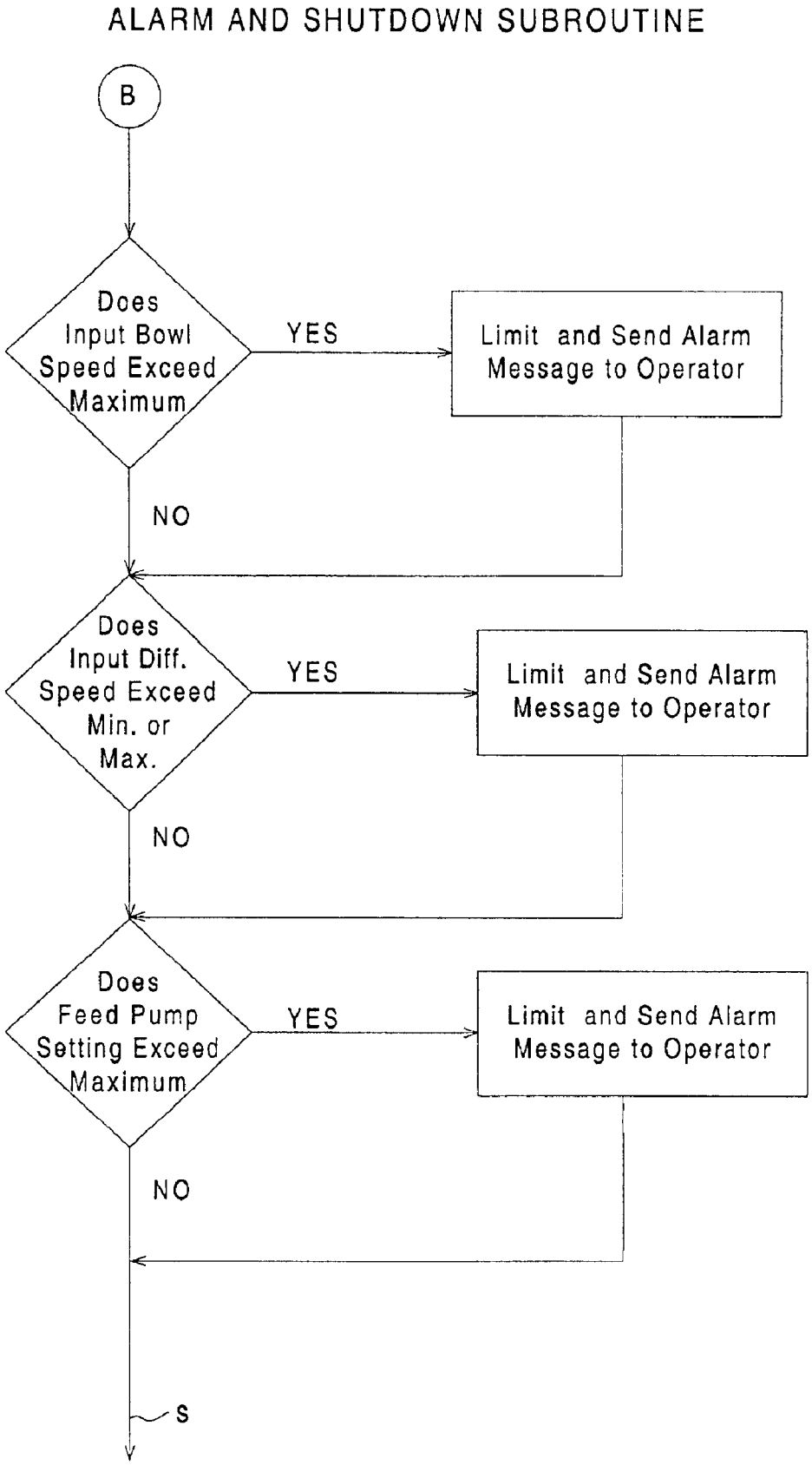
FIGS. 13–17 are the flow charts illustrating the logic of the alarm and shutdown subroutine; and, FIGS. 18–29 represent screen captures illustrating the user interface with the computer control system of the invention.
Figure 14:
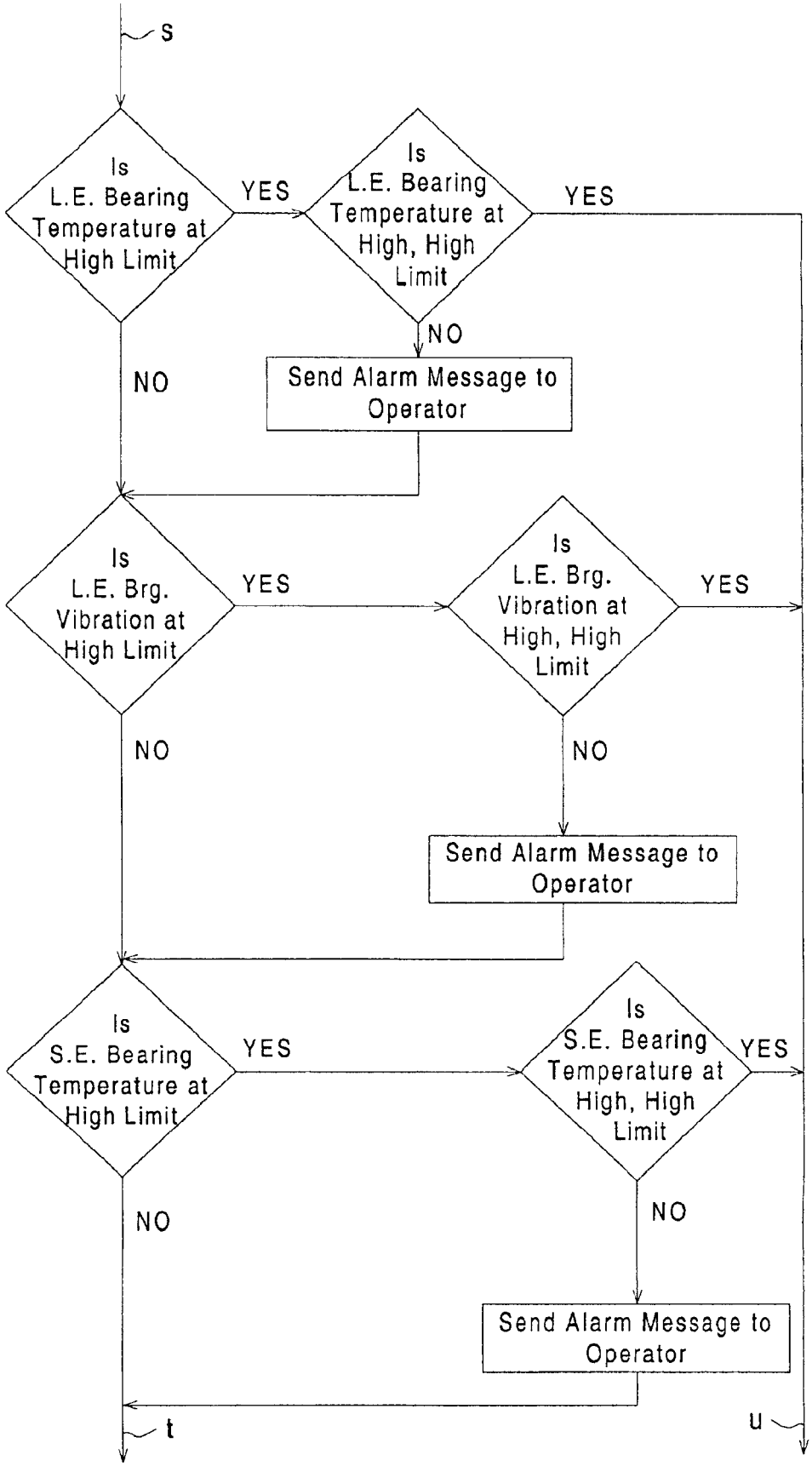
Figure 15:
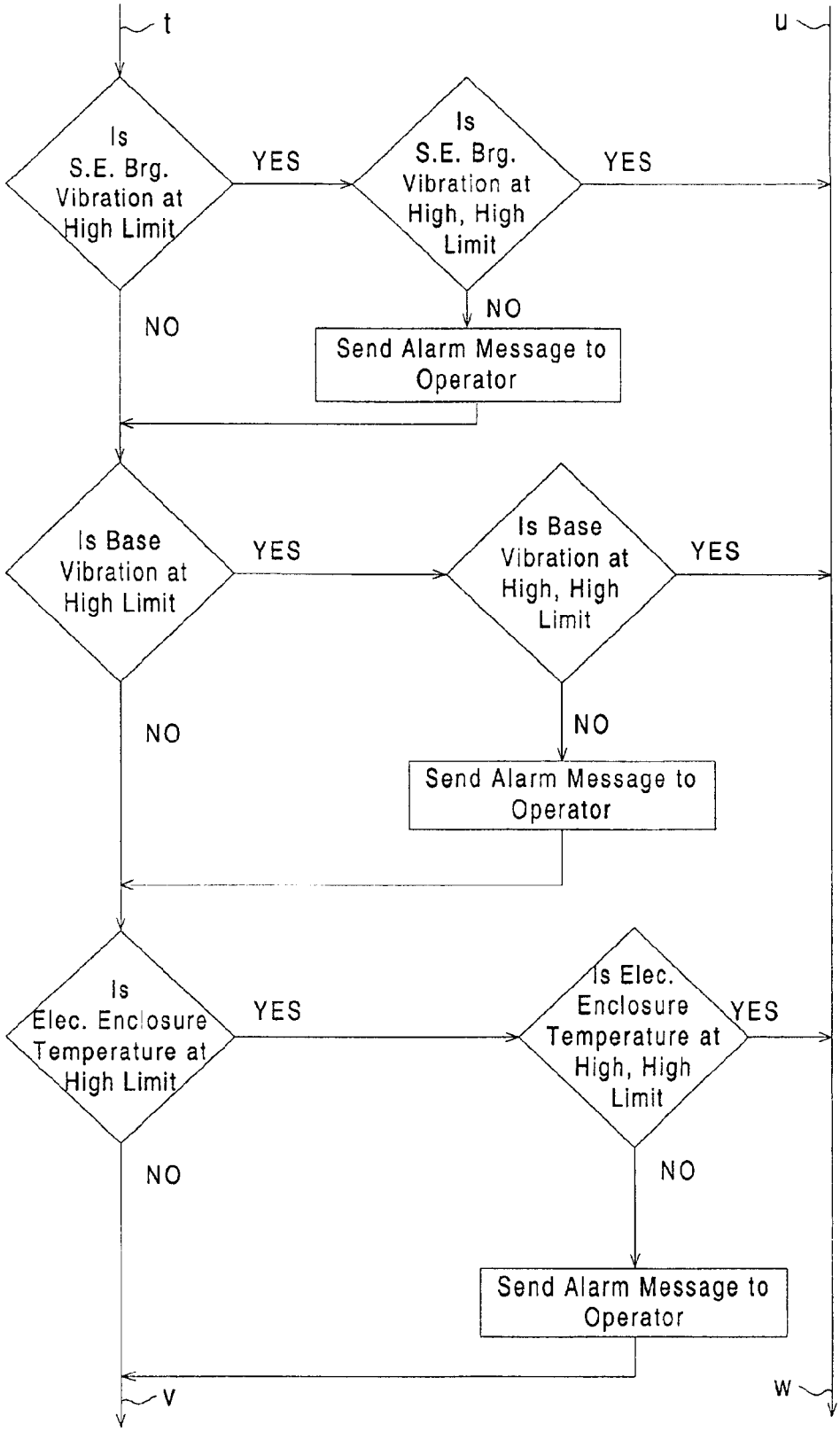
Figure 16:
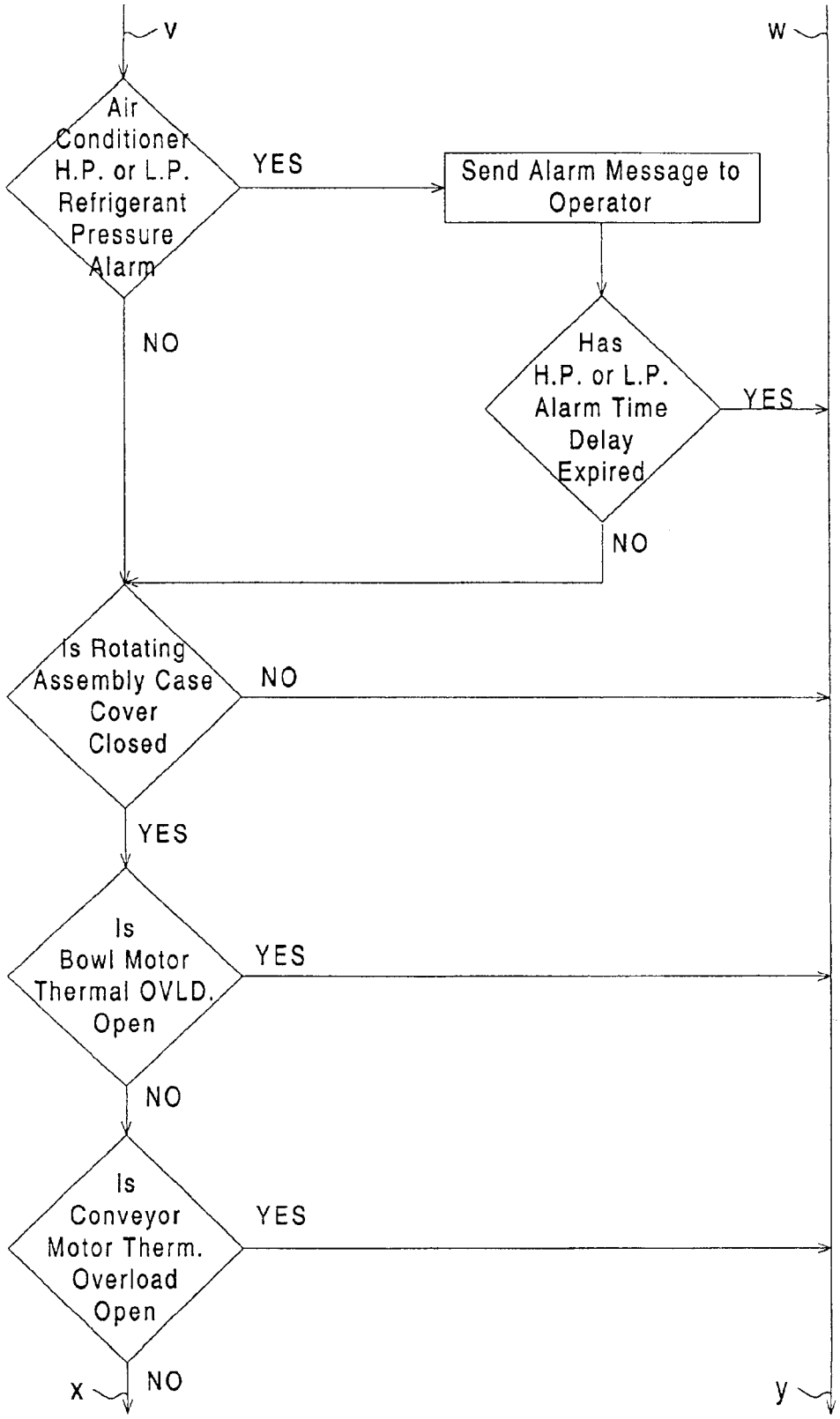
Figure 17:
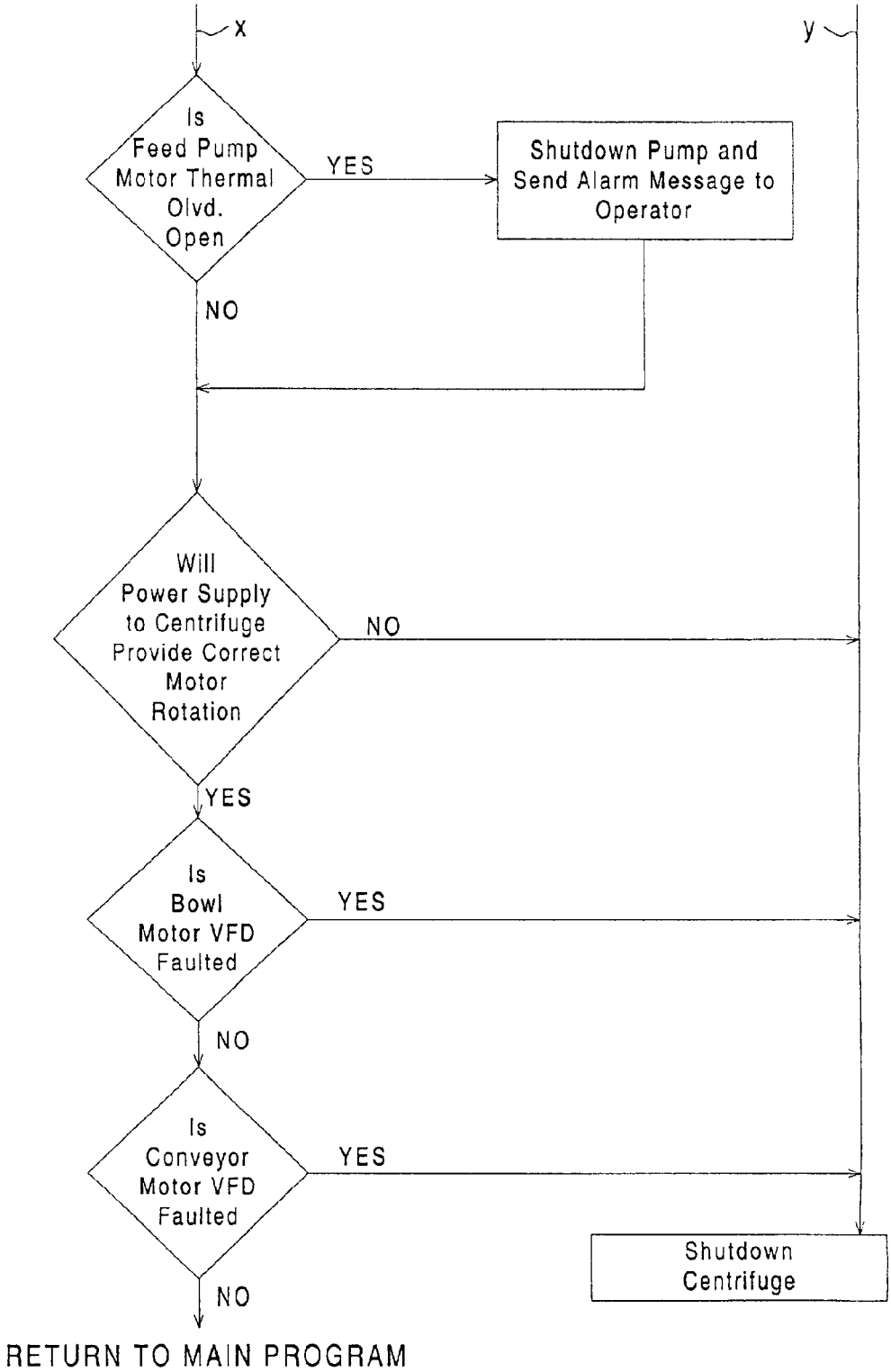

Adverting now to FIG. 1, centrifuge 10 of the inventive system includes a bowl 11 and a screw conveyor 12 the specific structure of which is well known in the art. The centrifuge 10 receives a slurry via conduit 45 into pump 15 which then pumps the slurry to the centrifuge via conduit 17. The bowl 11 is driven by bowl motor 19 via pulley arrangement 20, and screw conveyor 12 is driven by conveyor motor 21 via gear box 23. The high density solids, which are separated from the slurry, are discharged from centrifuge 10 through conduit 24. The remaining portions of the slurry (effluent) are ejected from the centrifuge via conduit 25. The bowl 11 is supported by two bearings 27 and 29.

The above described centrifuge system is computer operated. In this respect, in accordance with a computer program which is included in the compact disc appendix, and incorporated by reference herein, a local general purpose industrial hardened computer 30 monitors the torque of the conveyor motor 21 and bowl drive motor 19. Speed and directional information about the conveyor motor is sensed by encoder 46, and transmitted to conveyor drive 31 as well. Computer 30 also communicates with pump drive 34, operatively arranged to drive pump motor 35 which in turn drives pump 15. A remote general purpose computer 37 is linked to the local computer 30 via line 39 so that troubleshooting or operation of the system can be monitored and controlled from a remote location, if desired. In a preferred embodiment, the two computers are linked by a telephone modem using commercially available PC Anywhere® software, available from Symantec Corporation, 20330 Stevens Creek Blvd., Cupertino, Calif. It should be appreciated, however, that the two computers can be linked over a network (e.g., LAN), or over a global information network such as the Internet (later versions of PC Anywhere are capable of linking computers over the Internet). Also coupled to computer 30 are transducers associated with bearings 27 and 29 via lines 40 and 41, respectively, to thereby monitor the conditions (vibration and temperature) reflected at these bearings, as is also discussed in detail hereafter in relation to the flow charts and the descriptions of the various programs.

Broadly, in accordance with the present invention the mode of operation of the above described system produces efficient centrifuge operation with concurrent safe operation of the motors that run the centrifuge. Also, in some modes of operation, throughput of the slurry passing through the centrifuge is maximized while maintaining consistency of separation.

The present invention comprises three general levels of security with respect to operation. First, under some user-selected preprogrammed modes, the system automatically adjusts pump speed and flow while preventing the conveyor and bowl motors from operating in an overload condition, that is, above rated torque. Importantly, this is accomplished while holding bowl speed constant and screw conveyor speed constant (and therefor holding their respective motor speeds constant). Second, in the event rated torque is developed by either of the motors, the system in some modes will shut down the pump. Third, in the event either of the centrifuge motors begins to operate at a dangerous level above rated torque, the system in some modes will shut down the entire system, that is, the pump and the centrifuge will shut down. The torque limit for pump shutdown (level 2) and system shutdown (level 3) are predetermined and programmed into the computer of the invention.

With respect to the first level of protection, in this mode, the speed of rotation of the bowl 11 and the speed of rotation of the screw conveyor 12 are preset by the operator at specific values and maintained constant for each specific type of slurry. In this respect, the operator has knowledge of the characteristics of the specific slurry (e.g., drilling mud and trailings) which is received from the well, and he selects the bowl and screw conveyor speeds for this specific slurry for best separation of the trailings (solids). The torque of the conveyor motor and the torque of the bowl motor which are developed at the specific speeds are measured and monitored. Both of these torques are represented and displayed as a percent of rated torque of their respective motors. The torque associated with the motor operating at the highest percentage of rated torque is designated the predominant torque, and it is this torque which is fed into a PID feedback loop to control pump speed and flow. (Each motor has an associated PID feedback loop associated with it.) If the predominant torque varies from the desired percent of rated torque the computer causes the pump motor to vary the flow to the centrifuge 10 to thereby maintain the desired percent of rated torque while maintaining the speed of the bowl and the speed of the screw conveyor constant, albeit at different speeds. By virtue of the foregoing mode of operation the trailings are removed from the slurry in an efficient manner. In this respect, specific types and quantities of trailings are removed without removing more than those specific trailings or less than those specific trailings. In other words, if the speed of the bowl motor was increased, is drilling mud of less weight than the specific trailings would be removed from the slurry and discarded with the trailings. If the speed of the bowl was decreased, undesirable trailings would be retained in the slurry and conducted back to the tank, thereby lessening the efficiency of the separation. If the speed of the screw conveyor was increased, more than the specific trailings could be discharged and discarded, thereby possibly losing expensive drilling mud. If the speed of the screw conveyor motor was decreased, excess accumulations of trailings could be experienced on the inside of the bowl, which could results in loading the conveyor motor excessively. Most importantly, the system of the invention prevents either of the motors from overloading while simultaneously operating them at constant speeds, compensating for variable demands of load torque by varying pump flow and speed.

Reference has been made above to drilling mud and trailings. The drilling mud may be any composition well known in the art which is used in well-drilling operations in the search for oil, and it is used in the conventional manner. The trailings are the substances which are removed from the earth as a result of the drilling operation and are brought to the surface with the drilling mud.

The Software of the Invention

In addition to PC Anywhere described above, there are two general software aspects of the invention. The first software application is written in Rockwell Software's RSLogix™ 5, commercially available from Rockwell Automation, 1201 South Second Street, Milwaukee, Wis. RSLogix software is used to program the PLC-5 family of programmable logic controllers which, as is well known, are used to control a wide variety of industrial equipment. In the present invention, the PLCs control the variable frequency motor drives for both the screw conveyor and bowl motors, as well as the drive for the pump motor. The PLCs also control the various valves within the system, as well as power control relays.

The second software application is written in RSView™ also available from Rockwell Automation. This software is used to generate the user interface screens shown in FIGS. 18–29.

Source code listings for both of the above-mentioned software applications are included in the attached compact disc appendix, and incorporated herein by reference. It should be apparent to those having ordinary skill in the art that other software applications in other programming languages could accomplish the same result in substantially the same way as the software of the present invention, and these alternatives are intended to be within the spirit and scope of the invention as claimed.

Operation and Use of the Invention

At the outset, it should be appreciated that, while in a preferred embodiment, the screw conveyor motor is a 10 horsepower motor connected to the conveyor through a gearbox, and the bowl motor is a 50 horsepower motor, both of which are driven by variable frequency drives, that other horsepower combinations could be used, depending upon the loads expected. Automatic load sensing and feed pump control enable automated performance optimization. In a preferred embodiment, the bowl assembly can be operated in a range between 1 to 4000 RPM, which can result in an internal centrifugal acceleration of more than 3000 G's, although clearly the invention as claimed is not limited in scope to any particular horsepower and/or speed range. Similarly, to accommodate low levels of agitation and rapid solids removal, in a preferred embodiment, the conveyor is capable of differential speeds in the range of 1 to 100 RPM, although this range is not critical to the invention as claimed.

Each motor is powered by a high performance PWM (pulse width modulated) AC drive with IGBT (insulated gate bipolar transistor) outputs. In turn, each of the motor drives and other peripheral devices are controlled by an environmentally hardened IBM compatible personal computer. The PC and all devices communicate through a high-speed, machine level control network (e.g., DeviceNet).

This PC control enables long term data storage so that historical data can be logged into historical trends. In addition, with a remote PC, remote monitoring and control of the centrifuge can be accomplished from an adjacent room or from thousands of miles away. Various configurations are possible, regarding security and read/write capability, and a simple telephone line connection to the onboard high-speed modem or Ethernet connection to a Local Area Network (LAN) can provide multiple users "real-time" machine status information. Remote connection capability can also be made over the Internet, and is a powerful tool for troubleshooting and correcting suspected malfunctions without going on-site.

The operational methodology of the invention, in a preferred embodiment and operating mode, gives the PC complete control over the feed pump through a third AC drive. This enables multiple modes of operation, some being predefined and some being user configurable. Predefined modes consist of typical settings for Solids Removal and Barite Recovery. If these pre-defined settings are not sufficient or optimum, custom setups can be saved by the operator and recalled by clicking a single button. Additionally, feed pump control can be automatic or manual. Automatic control, primarily designed for Barite Recovery, maximizes centrifuge throughput by employing a PID (proportional-integral-derivative) loop. This increases pump output to the centrifuge until the operator input torque set point is reached on either the bowl or conveyor drive motors. If properties of the feed slurry change, the PID loop will dynamically adjust pump output to maintain the torque set point (the operator actually sets motor speed, and thereby impliedly sets the torque set points). This enables even less experienced operators to safely and effectively operate and monitor the apparatus.

The PC also continuously runs a diagnostic program which provides the operator with machine critical status information. Real-time trends of main bearing temperature and vibration levels as well as base vibration and enclosure temperature can be viewed on demand. Messages inform the operator when minimum and maximum bowl, conveyor and pump speeds have been reached. In the event alarms or faults do occur, detailed descriptions pinpoint the cause of the malfunction and enable rapid recovery.

Operation of the invention is best understood with reference to the screen captures of FIGS. 18–29. These screen captures illustrate the user interface of the invention. In operation, the operator operates much of the system from a control panel including a monitor and pointing device, such as a mouse. In a preferred embodiment, the system is so easy to use that a keyboard interface is not required. It should be appreciated, however, that other means of communicating with the computer could be used, such as keyboards, voice recognition, and touch-screens, to name but a few.

Figure 18:
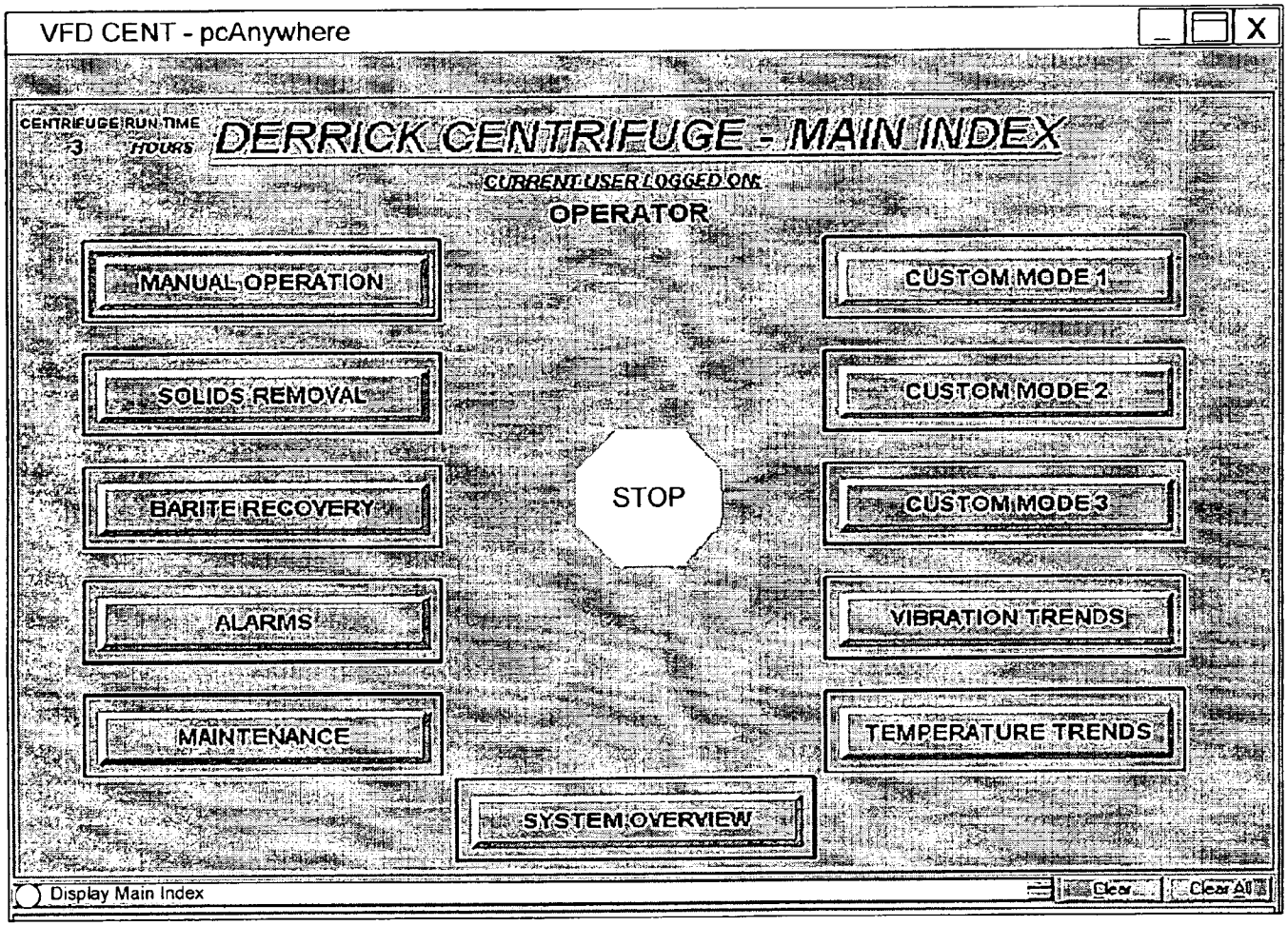

The main system screen is shown in FIG. 18. From this screen the operator has a variety of options and modes of operation, as shown. The operator can select Manual Operation, Solid Removal mode of operation, Barite Recovery mode of operation, Alarms, Maintenance, one of three different Custom Modes (Custom Mode 1, Custom Mode 2, Custom Mode 3), Vibration Trends, Temperature Trends, or System Overview, each of which is described seriatim herebelow.

Figure 19:
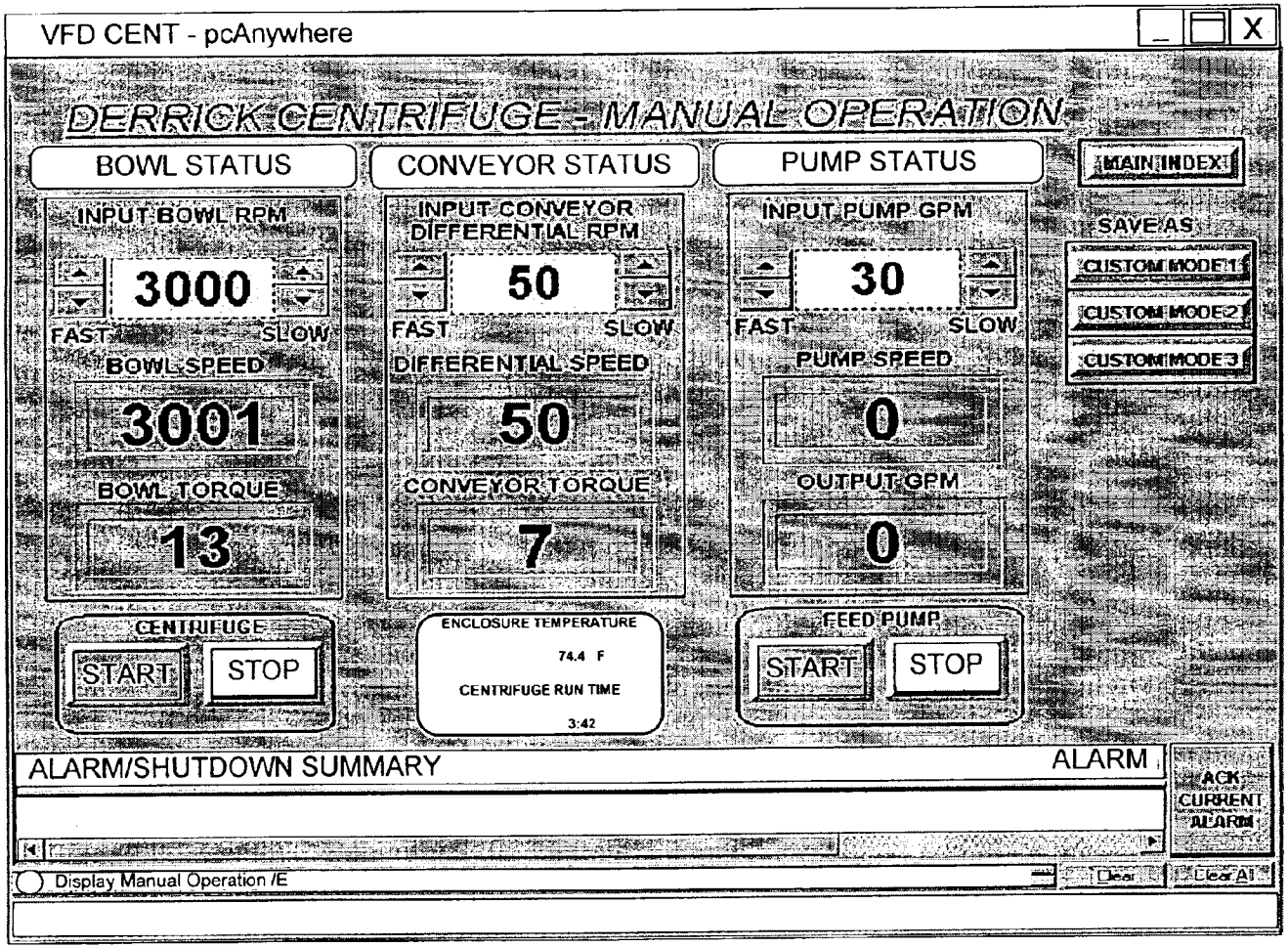

If the operator clicks the MANUAL OPERATION button in the screen shown in FIG. 18, the screen shown in FIG. 19 appears. On this screen, the operator can select and set (by mouse interaction with the up/down (▼/▲) icons on the screen) desired Input Bowl RPM and Input Conveyor Differential RPM which indirectly sets the screw conveyor speed (the conveyor differential RPM is the difference between the bowl RPM and the screw conveyor RPM). In the example shown, the operator has set the bowl speed at 3000 RPM, and the conveyor differential speed at 50 RPM. In the MANUAL OPERATION mode, the operator can also set the pump flow rate and, in the example shown in FIG. 19, the operator has set the pump to a flow rate of 30 GPM. Once the desired parameters are set (as indicated as "black on white" numbers in the fields adjacent the up/down icons), the operator can start the centrifuge by clicking on the START button under the word CENTRIFUGE, and can start the feed pump by clicking on the START button under the words FEED PUMP. Once the centrifuge and pump have been started, the actual measured bowl speed (3001 RPM), bowl motor developed torque as a percentage of rated torque (13%), differential speed (50 RPM), screw conveyor motor developed torque as a percentage of rated torque (7%), pump speed, and pump output GPM are displayed. (In FIG. 19, the pump speed and pump output GPM are both zero, because the operator has not yet started the feed pump.) In FIG. 19, these measured parameters are shown as "black on gray" in fields under their respective headings, under the general headings "Bowl Status", "Conveyor Status", and "Pump Status", respectively. This screen also displays enclosure temperature and centrifuge run time. The preset settings from this screen can be saved as Custom Modes for future use by clicking on the appropriate Custom Mode button (1, 2 or 3) under the SAVE AS wording on the upper right of the screen. This screen also provides the operator with an Alarm/Shutdown Summary in the window at the bottom of the screen, where he can view or acknowledge the most recent alarm. Example of alarm conditions include a centrifuge motor exceeding rated torque, excessive bearing temperature or vibration, excessive enclosure temperature, and a number of other conditions.

Figure 20:
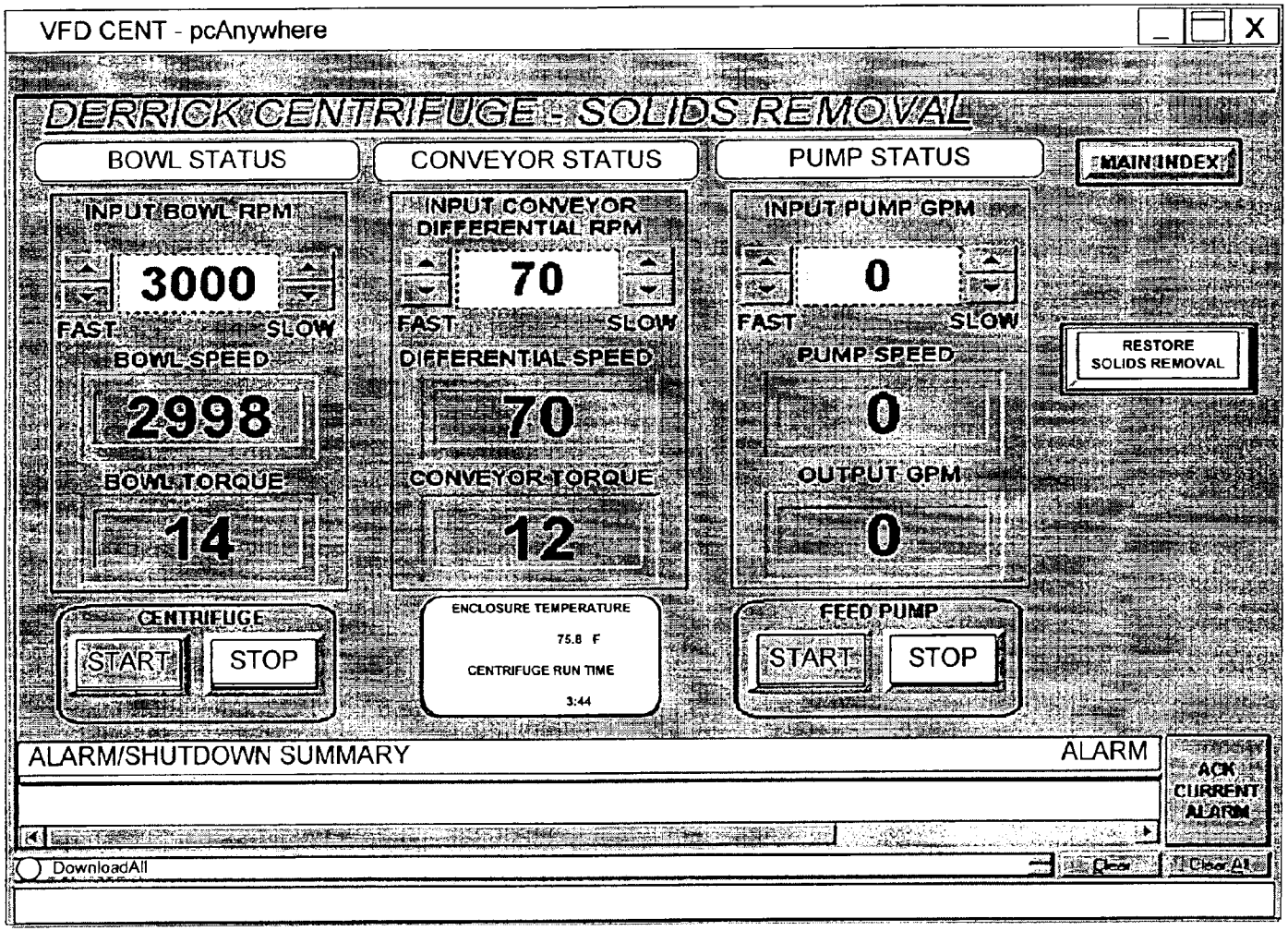

Selection of the SOLIDS REMOVAL button on the screen shown in FIG. 18 launches the screen shown in FIG. 20. This mode includes preset (at the factory) settings for desired bowl speed and conveyor differential speed to achieve a desired consistency of separation of the slurry. As the slurry is presented to the motors as a load, each motor (bowl and conveyor) develops the necessary torque to meet the demands of the load at the preset speeds. The operator can change the preset speeds during operation. In FIG. 20, the operator has started the centrifuge, as indicated by the display of bowl RPM and conveyor differential RPM, but not yet activated the feed pump (by clicking on the START button under the words FEED PUMP). Once he starts the feed pump, the computer will automatically display the speed and flow of the pump. In this and other manual and automatic modes of operation in a preferred embodiment, the computer is programmed to monitor torques developed by the conveyor and bowl motors and continuously (at a sampling rate of 50 ms) compares the developed torque to rated torque. If the developed torque of either motor reaches a first preset level (above rated torque), the computer will shut down the pump. If the developed torque of either motor reaches a second preset level above the first preset level, the computer will shut down the centrifuge.

Figure 21:
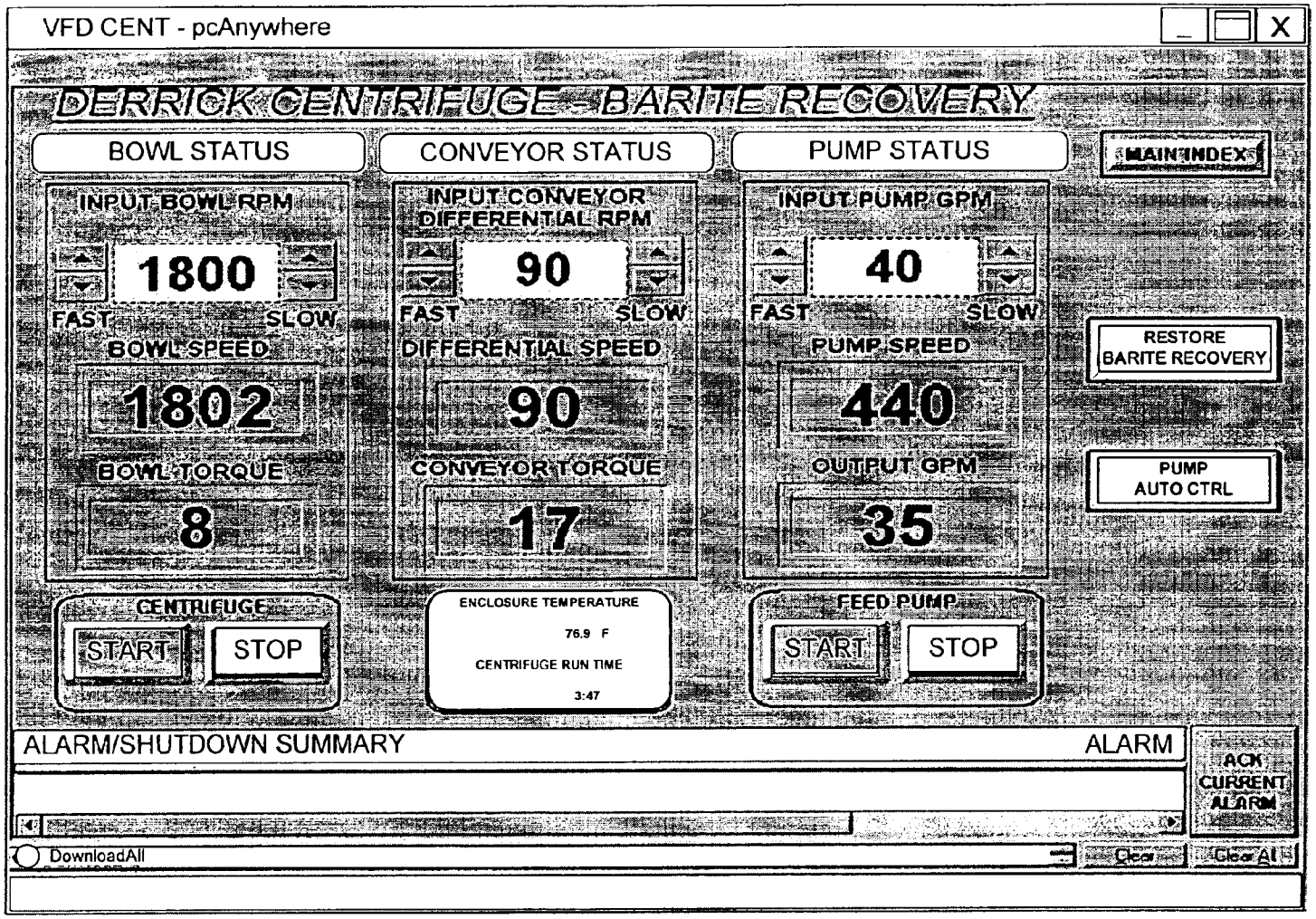

FIG. 21 illustrates an input screen the operator would select for the BARITE RECOVERY mode of operation. This is an automatic mode, as will be described herebelow, and as indicated by the PUMP AUTO CTRL button shown on the screen. In this mode, the pump speed and flow rate are automatically controlled in response to measured torque from the screw conveyor and bowl motors. It should be appreciated that, although the auto control mode is described herebelow with respect to a barite recovery program in an oil drilling application, this mode of operation obviously has many other applications.

By way of introduction to the oil drilling application, barite, or heavy spar, is a sulfate of barium, $BaSO_4$, found in nature as tabular crystals or in granular or massive form and has a high specific gravity. Most crude barite requires some upgrading to minimum purity or density. Most barite is ground to a small, uniform size before it is used as a weighting agent in petroleum well drilling mud specification barite. Barite is relatively expensive, and an important objective of a preferred embodiment of the present invention is to recover barite from the slurry in an oil drilling operation for re-use. In the mode shown in FIG. 21, then, the operator has set the bowl speed to 1800 RPM, and the conveyor differential speed to 90 RPM. He has also set the pump GPM to 40. The system, through the aforementioned PID loop and computer control, is adjusting the pump speed (every 50 ms), shown in the drawing at 440 RPM, to achieve the desired pump GPM. At the instant in time when the screen capture was made, the pump GPM was 35, and presumably climbing toward the target of 40 GPM. Since the system includes a PID feedback loop, the motor operating closest to its rated torque (defined as the predominant torque) is used in the PID loop to control the pump speed and flow. The idea is to control the pump to optimize operation while simultaneously protecting against either conveyor or bowl motors exceeding their rated torque limits. Both the speed and flow of the pump will vary during operation as the system in this mode operates to maintain constant bowl speed (a first speed) and constant conveyor speed (a second speed). In operation, the computer senses and measures the torque developed by the screw conveyor motor and bowl motor. The measured torques are compared against the rated torques of the respective motors and then represented as a percentage of rated torque. Whichever motor is operating at a higher percentage of rated torque is defined as the predominant torque motor. It is this motor's (predominant) torque which controls a PID loop to control pump flow and speed. It is possible during operation that one motor predominates, and, at a later point in the same operation, that another motor predominates. Each motor has its own PID control loop, each of which is operatively arranged to control pump speed and flow when called upon to do so by the computer.

Figure 22:
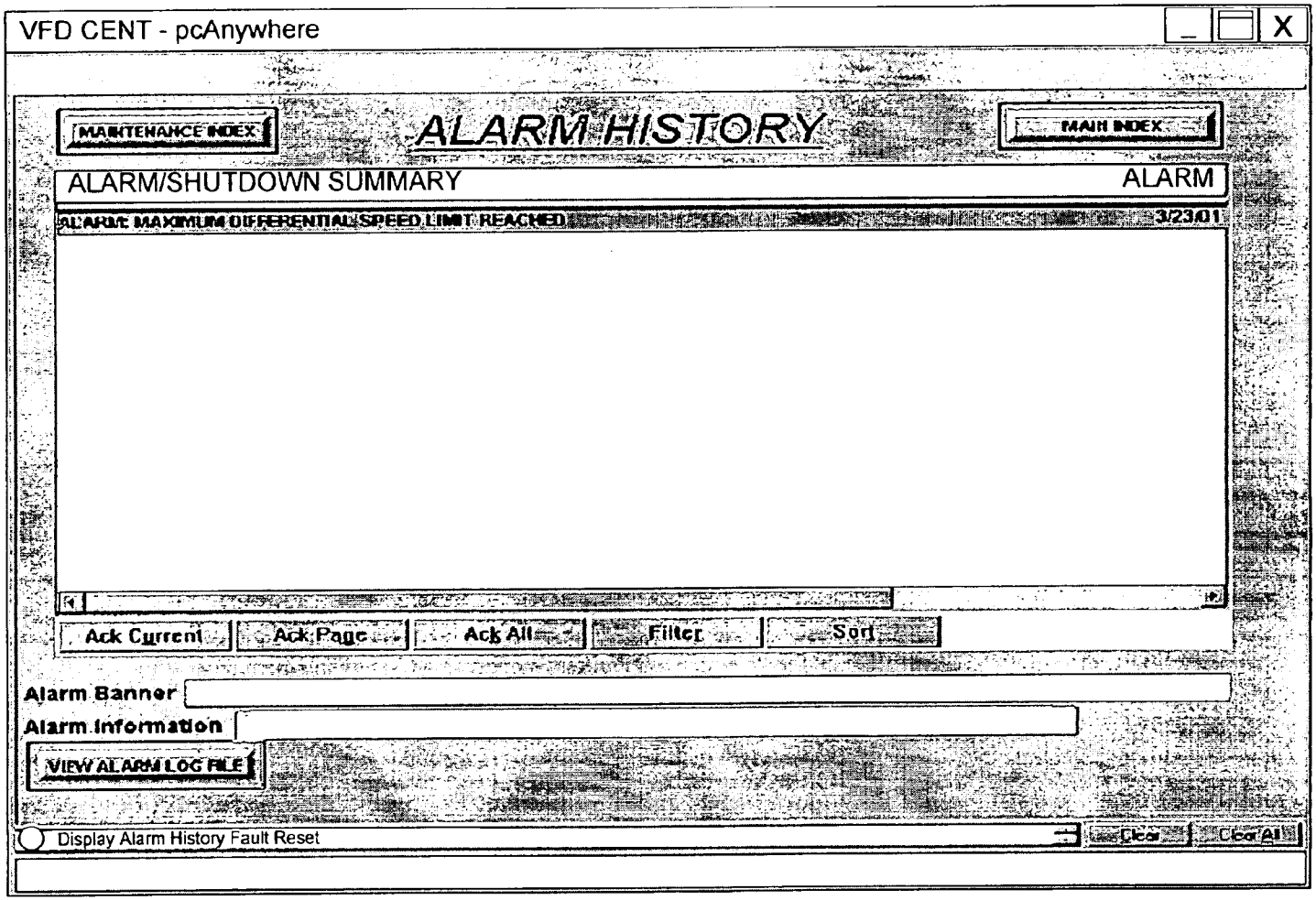
Figure 23:
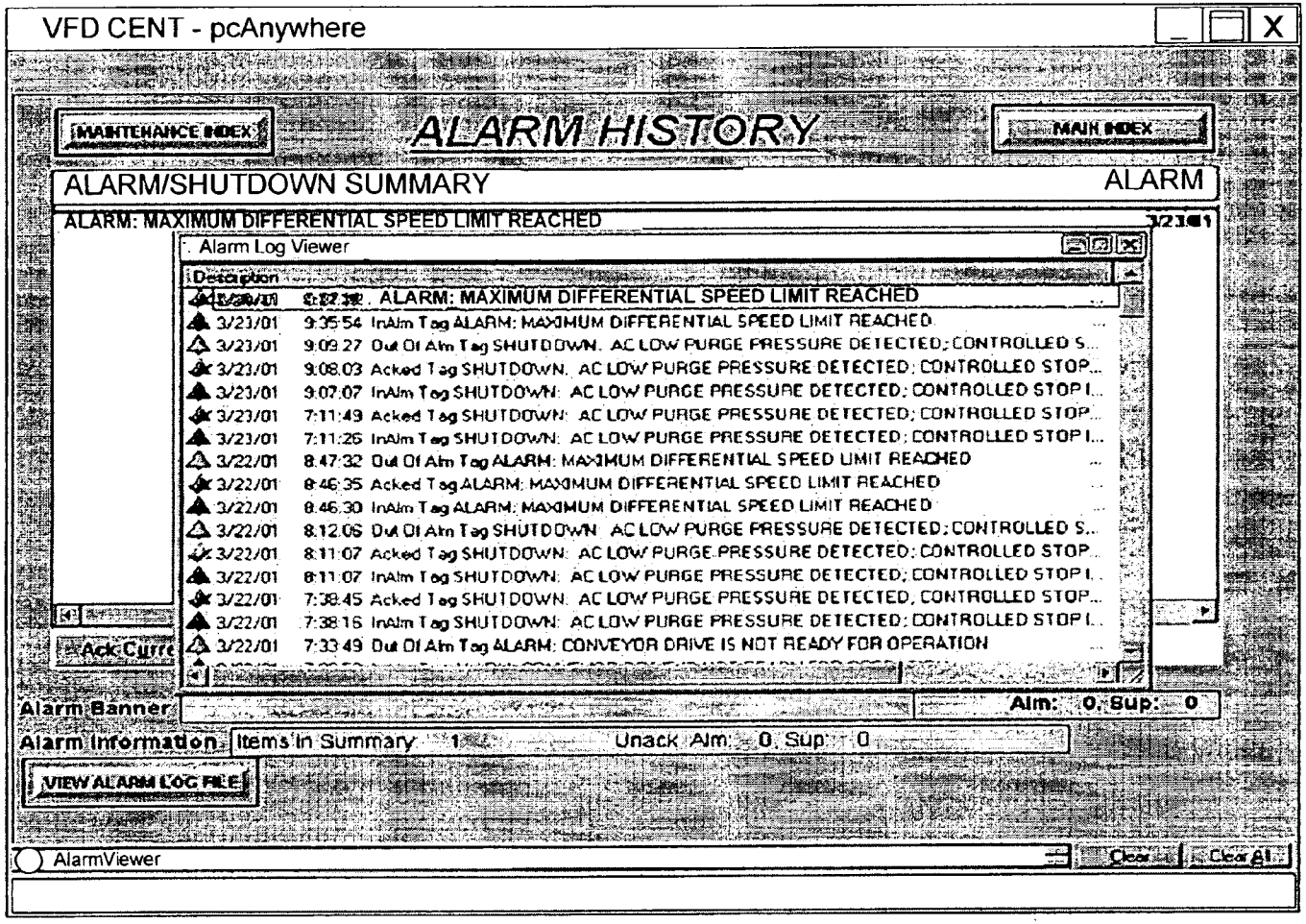

As described previously, the system is preprogrammed to monitor various alarm conditions. For example, FIG. 22 illustrates the announcement of a specific alarm condition, namely, Maximum Differential Speed Limit Reached. It is also possible to view a log of historical alarm notices, by clicking on the VIEW ALARM LOG FILE button in the lower left section of the screen shown in FIG. 22. Once this button is clicked, an alarm log such as that shown in FIG. 23 appears. The log includes detailed information including the date and time of the alarm, and a detailed description of the alarm itself.

Figure 24:
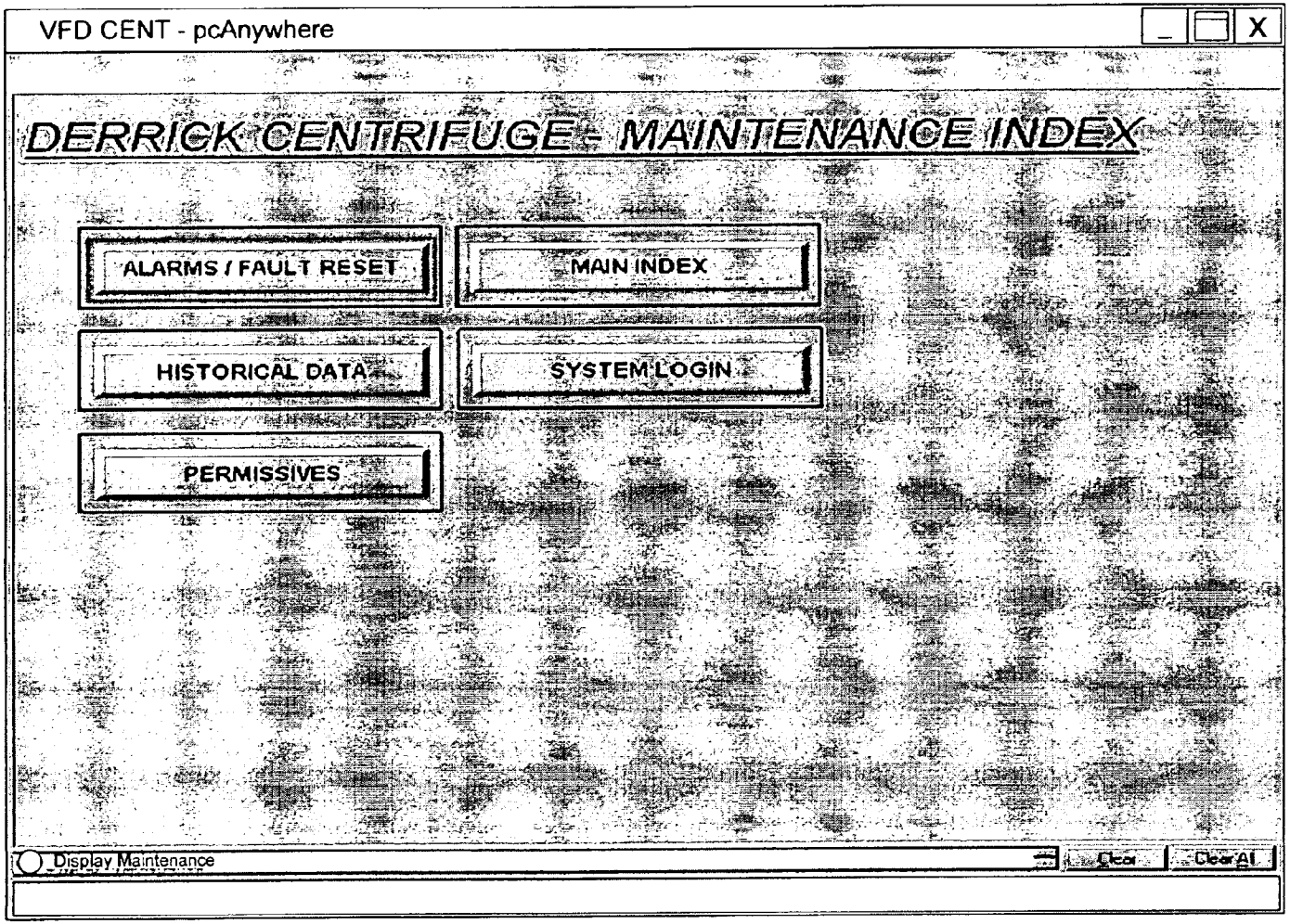
Figure 25:
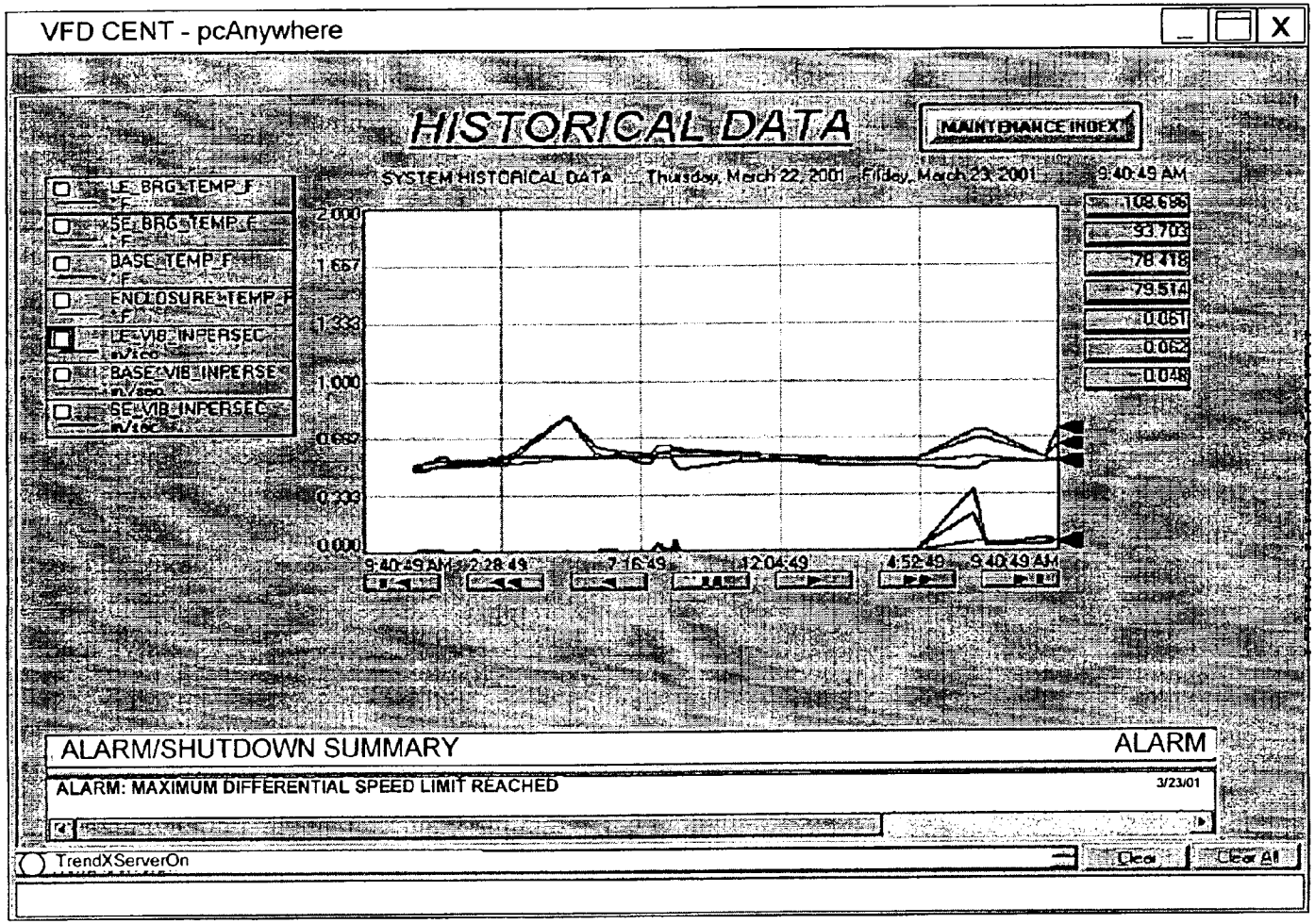
Figure 26:
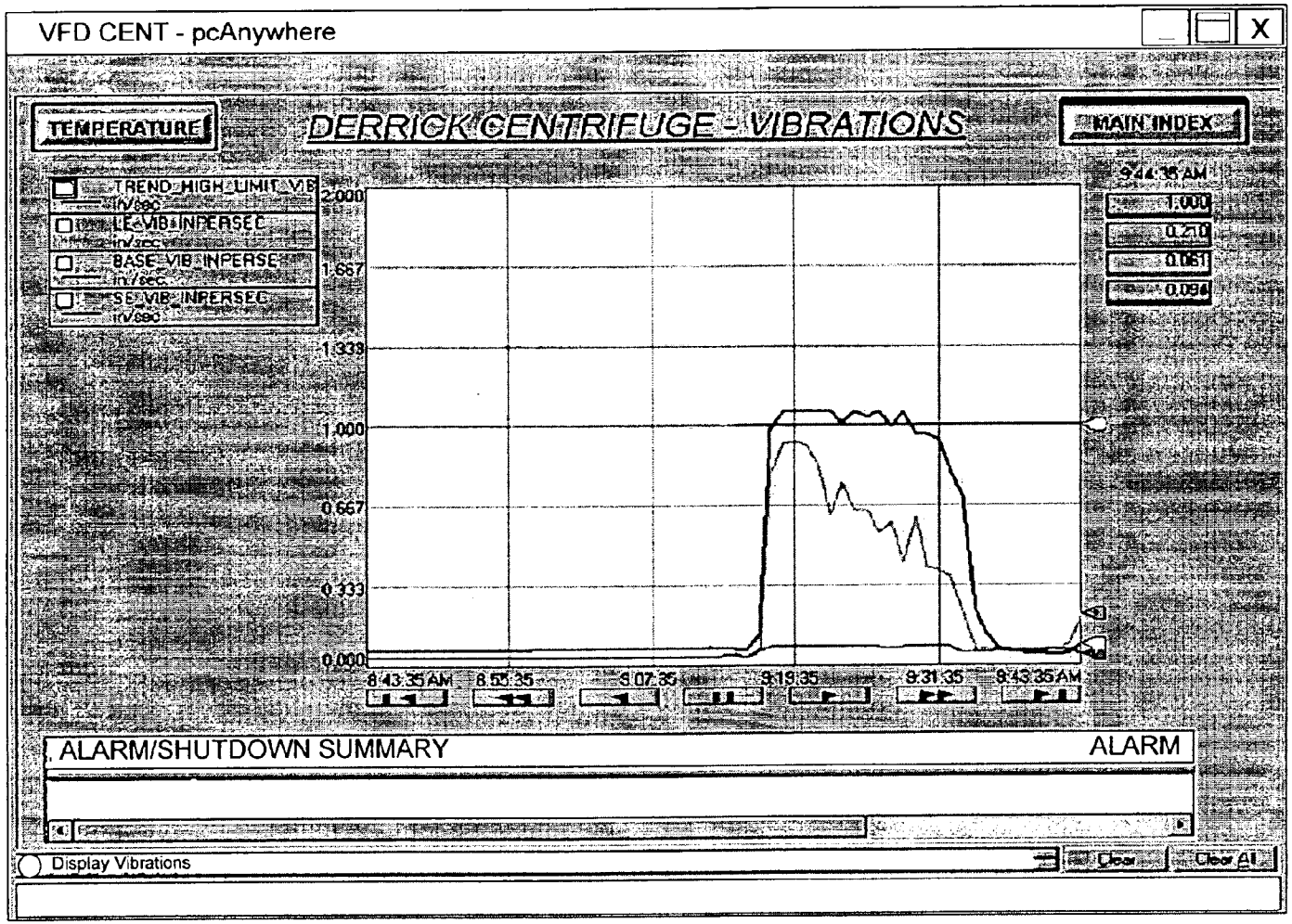
Figure 27:
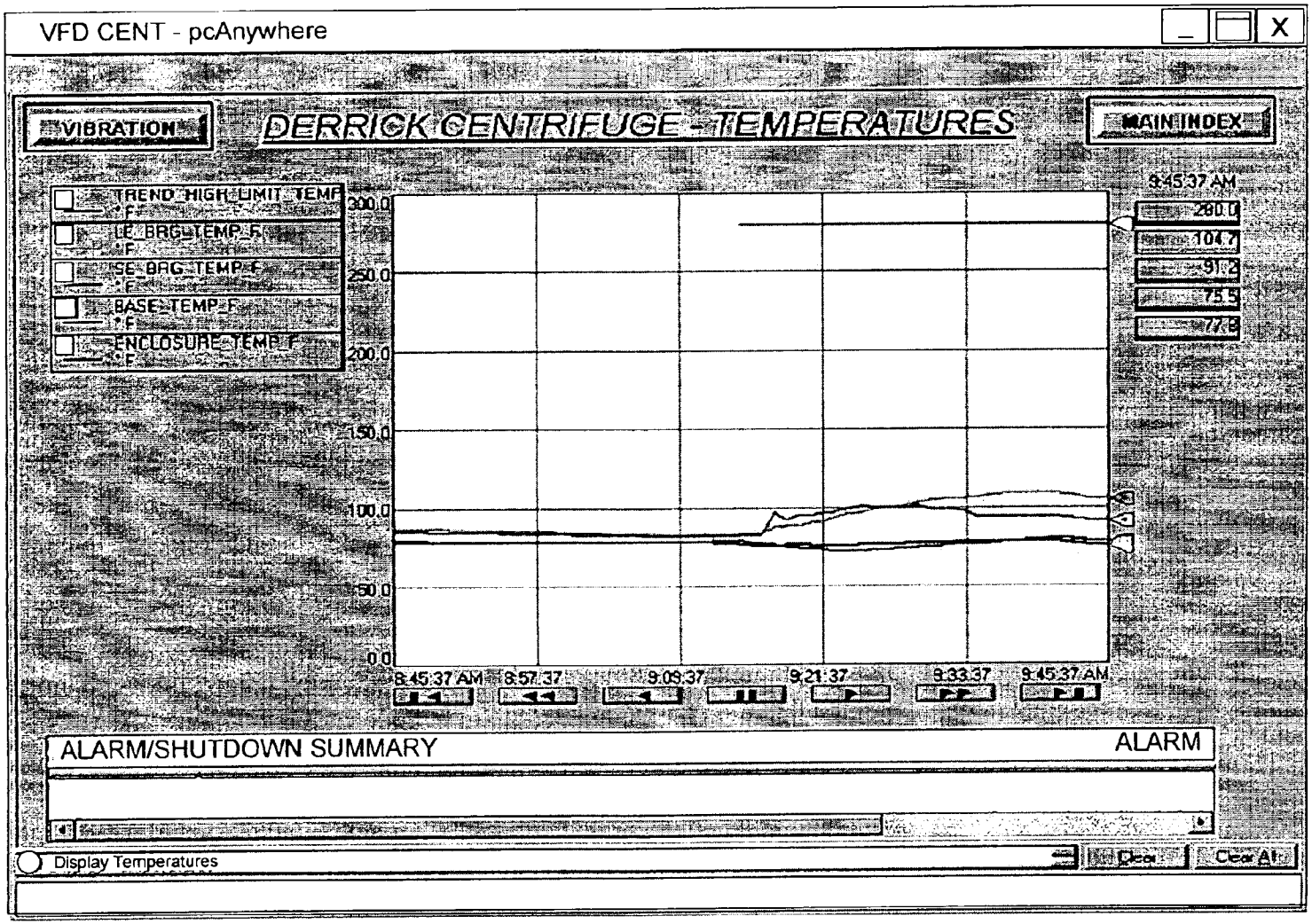
Figure 28:
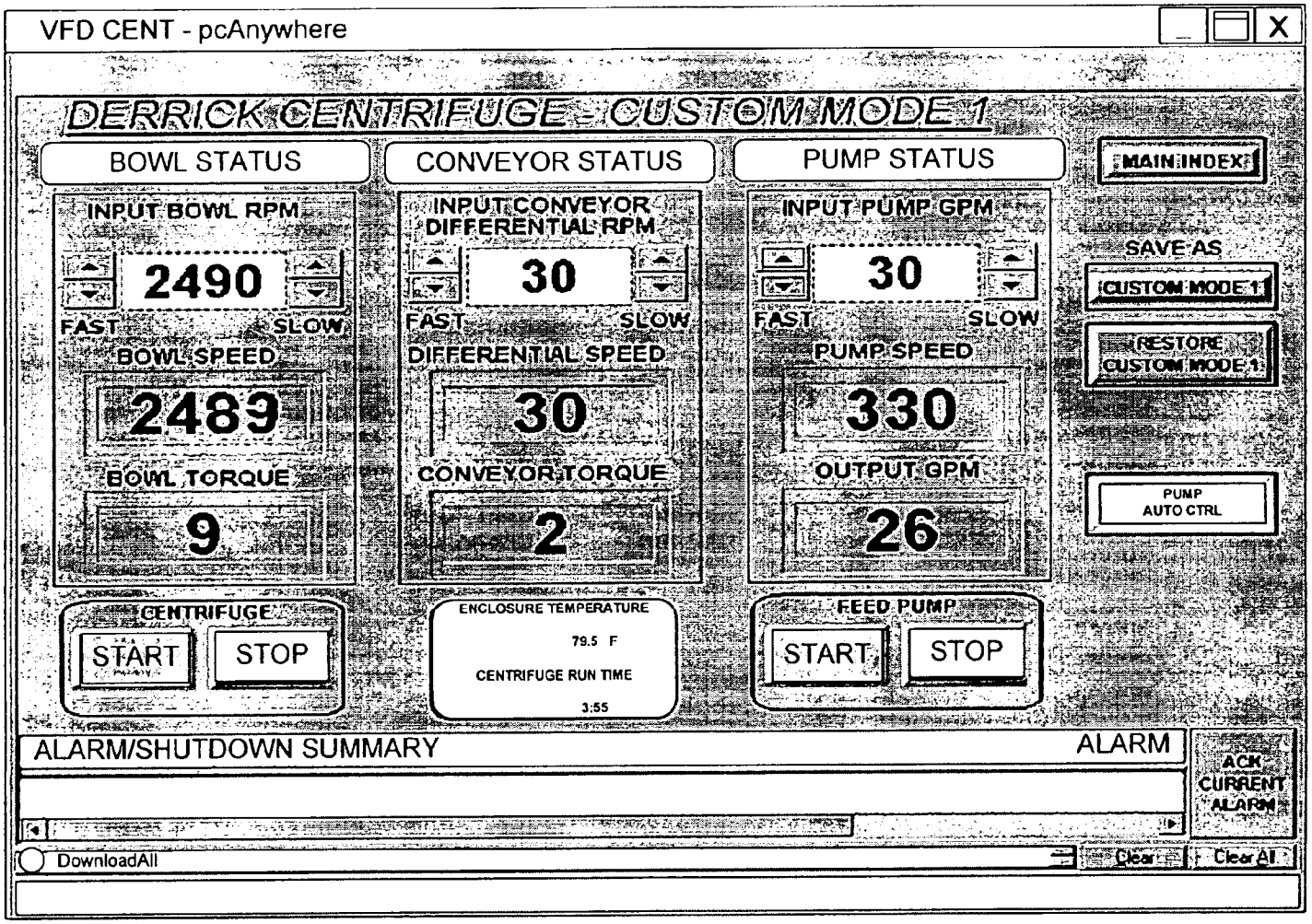

From the main screen shown in FIG. 18, the operator can also access the Maintenance Index, which launches a set of options shown in the screen capture of FIG. 24. Some of these options (System Login and Permissives) are not particularly germane to the invention. The ALARMS/FAULT reset button is used to reset alarms. The MAIN INDEX button is used to return to the screen shown in FIG. 18. The HISTORICAL DATA button is used to view various historical data, such as that shown in FIG. 25 for bearing temperature and vibration and enclosure temperature, both of which may be displayed in more detail as shown in FIGS. 26 and 27, which show vibration and temperature data, respectively.

At any time during operation, the operator may save current operating inputs in a CUSTOM MODE file, as described previously and shown with respect to FIG. 18. The operator can then select those pre-saved operating parameters for operation as shown in Figure where certain preset operating parameters have been stored as CUSTOM MODE 1.

Figure 29:
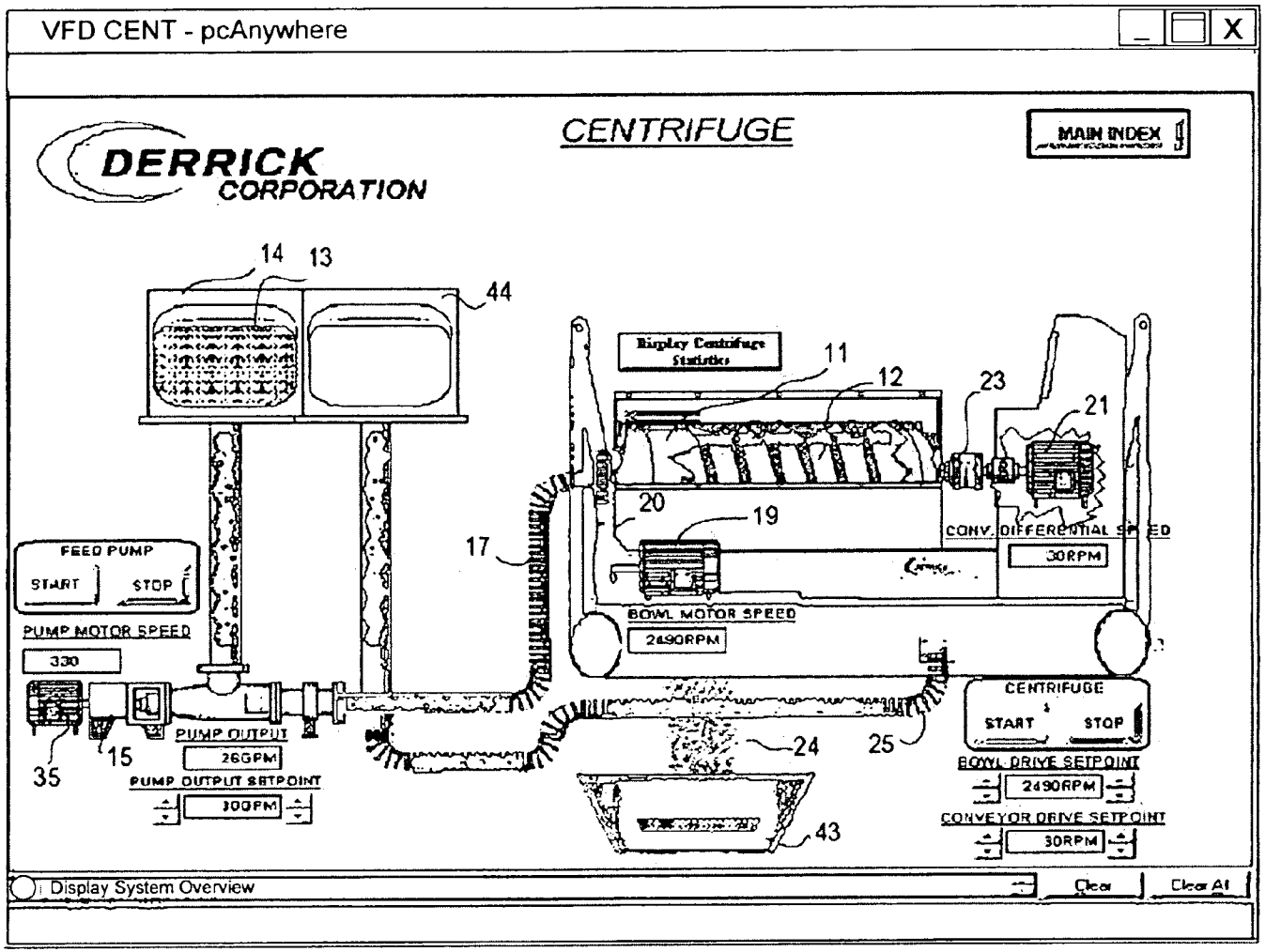

Finally, a SYSTEM OVERVIEW may be selected from the screen shown in FIG. 18. When this option is selected, a dynamic view of the overall system launches as shown in FIG. 29. It should be appreciated that the system shown in FIG. 29 is slightly different from the system shown in FIG. 1, although many structural elements are the same. FIG. 29 illustrates a dual tank system, where solids are separated and emptied into hopper 43, and other effluent is pumped to separate tank 44. Otherwise, operation of this type of system is identical to that previously described with respect to the system shown in FIG. 1.

It should be appreciated that the computer software of the invention, included in a program listing appendix on compact disc, operates the computer, and ultimately controls the associated motors that run the centrifuge. The enclosed software is sufficient in and of itself to enable one having ordinary skill in the art to make the invention, and the screen captures illustrated in the drawing figures are sufficient to enable one having ordinary skill in the art to use the invention. The flow charts included in FIGS. 2–17 are self-explanatory and merely explain in more concise terms the logic and flow of the computer program and motor and pump control.

Thus, it should be apparent that the objects of the invention are efficiently obtained, but it should also be understood that modifications, changes and substitutions are intended in the foregoing, some of which have been specifically described, and that these are intended to be within the spirit and scope of the invention as claimed.

What is claimed is:

1. In a drilling mud reclamation system having a tank which receives a slurry of drilling mud and trailings which have been produced during the process of drilling a hole in the earth and having a centrifuge for separating the trailings from the slurry, said centrifuge having a bowl driven by a bowl motor and a screw conveyor in said bowl driven by a screw conveyor motor, and a conduit between said bowl and said tank from receiving said slurry minus the trailings which were centrifuged therefrom and a pump for pumping said slurry to said centrifuge, the improvement of a general purpose computer specially programmed to drive said bowl motor at a first substantially constant speed, to drive said screw conveyor motor at a second substantially constant speed, to compare respective operating torques of said bowl motor and said screw conveyor motor, at said first and second substantially constant speeds, respectively, to a torque set point, and to cause said pump to adjust its flow to said centrifuge in response to a first torque comprising said respective operating torque for whichever of said screw conveyor motor or bowl motor is operating closest to its respective rated torque, wherein adjusting said flow comprises decreasing said flow in response to said first torque being greater than said set point and increasing said flow in response to said first torque being less than said set point.

2. The improvement recited in claim 1 wherein said torque set point is a percentage of rated torque.

3. A centrifuge for centrifuging a slurry, comprising:

a bowl driven by a bowl drive motor;

a screw conveyor driven by a screw conveyor drive motor;

a pump driven by a pump motor;

a bowl drive unit operatively arranged to drive said bowl drive motor;

a conveyor drive unit operatively arranged to drive said screw conveyor drive motor;

a pump drive unit operatively arranged to drive said pump drive motor; and, a general purpose first computer specially programmed to control said bowl drive unit to drive said bowl drive motor at a first constant speed and to control said screw conveyor drive unit to drive said screw conveyor drive motor at a second constant speed and to monitor the torques of said bowl drive motor and said screw conveyor drive motor, while simultaneously controlling said pump drive unit to variably control flow of said slurry through said centrifuge in response to variations in developed torque of whichever of said bowl motor or screw conveyor motor which is operating closest to its rated torque.

4. The apparatus recited in claim 3 further comprising means for controlling said first computer from a remote location.

5. The apparatus recited in claim 4 wherein said means for controlling said first computer from a remote location comprises a second computer specially programmed to control said first computer over a network.

6. The apparatus recited in claim 4 wherein said means for controlling said first computer from a remote location comprises a second computer specially programmed to control said first computer via modem.

7. The apparatus recited in claim 4 wherein said computer is specially programmed to control said bowl drive unit to drive said bowl drive motor at a first constant speed and to control said conveyor drive unit to drive said screw conveyor drive motor at a second constant speed to maintain consistency of separation of said slurry, while simultaneously controlling said pump drive unit to regulate flow of said slurry through said centrifuge.

8. The apparatus recited in claim 7 further comprising a first PID feedback loop for said bowl motor operatively arranged to control said pump motor when said bowl motor is operating at a higher percentage of its rated torque than said screw conveyor motor is operating with respect to its rated torque.

9. The apparatus recited in claim 7 further comprising a second PID feedback loop for said screw conveyor motor operatively arranged to control said pump motor when said screw conveyor motor is operating at a higher percentage of its rated torque than said bowl motor is operating with respect to its rated torque.

* * * * *